US006893356B2

(12) United States Patent
Thompson

(10) Patent No.: US 6,893,356 B2
(45) Date of Patent: May 17, 2005

(54) GOLF PUTTING MACHINE AND METHOD

(76) Inventor: Dean J. Thompson, 4847 Clybourn Ave., North Hollywood, CA (US) 91601

( * ) Notice: Subject to any disclaimer, the term of this patent is extended or adjusted under 35 U.S.C. 154(b) by 0 days.

(21) Appl. No.: 10/739,899

(22) Filed: Dec. 17, 2003

(65) Prior Publication Data

US 2004/0152535 A1 Aug. 5, 2004

Related U.S. Application Data

(60) Provisional application No. 60/434,326, filed on Dec. 17, 2002.

(51) Int. Cl.[7] ..... A63B 69/36

(52) U.S. Cl. ..... 473/257; 473/258; 473/260

(58) Field of Search ..... 473/257, 258, 473/260, 261, 263, 264, 219, 226

(56) References Cited

U.S. PATENT DOCUMENTS

| | | | | | |
|---|---|---|---|---|---|
| 1,545,648 | A | | 7/1925 | Fletcher | |
| 2,084,901 | A | * | 6/1937 | Eisenberg | 473/229 |
| 2,084,902 | A | * | 6/1937 | Eisenberg | 473/229 |
| 2,340,793 | A | * | 2/1944 | Arthur | 473/229 |
| 3,073,602 | A | | 1/1963 | Bell | |
| 3,471,155 | A | | 10/1969 | Donaldson | |
| 3,953,035 | A | * | 4/1976 | Beckisk | 473/229 |
| 4,153,255 | A | | 5/1979 | Woodson | |
| 4,334,684 | A | | 6/1982 | Sterling | |
| 4,437,669 | A | | 3/1984 | Pelz | |
| 4,449,708 | A | | 5/1984 | Humphrey | |
| 4,468,034 | A | * | 8/1984 | Duclos | 473/242 |
| 5,074,565 | A | | 12/1991 | Tucker | |
| 5,435,547 | A | | 7/1995 | Lee | |
| 5,437,458 | A | | 8/1995 | Springer | |
| 5,776,007 | A | * | 7/1998 | Kendall et al. | 473/258 |
| 5,776,016 | A | | 7/1998 | Benoit et al. | |
| 5,797,804 | A | * | 8/1998 | Chen | 473/260 |
| 5,919,096 | A | * | 7/1999 | Kim | 473/159 |
| 6,458,039 | B1 | * | 10/2002 | Fontes | 473/258 |
| 6,699,141 | B1 | * | 3/2004 | Florian | 473/257 |
| 6,716,113 | B1 | * | 4/2004 | Manning et al. | 473/261 |
| 2004/0152535 | A1 | * | 8/2004 | Thompson | 473/257 |

FOREIGN PATENT DOCUMENTS

| | | |
|---|---|---|
| GB | 2020983 | 4/1998 |

OTHER PUBLICATIONS

Copy of International Search Report With Above–Listed Patents.

* cited by examiner

*Primary Examiner*—Raleigh W. Chiu
(74) *Attorney, Agent, or Firm*—Stephen M. Nipper; Dykas, Shaver & Nipper

(57) ABSTRACT

A golf putting training method and apparatus for teaching a golfer how to swing a golf club head through a stroke path to strike a golf ball. The method and apparatus mechanically controlling the front to back movement of the club head along a stroke path to be generally parallel to the stroke path, mechanically controlling the club head to be generally perpendicular to the stroke path, and mechanically controlling the arc of the club head within the stroke path to follow a predetermined arc. The pitch of the club head face and also be mechanically controlled.

14 Claims, 21 Drawing Sheets

GOLF PUTTING MACHINE AND METHOD

PRIORITY

This application claims the priority date of the provisional application entitled "Z Factor putting system" filed by Dean Thompson on Dec. 17, 2002, with Ser. No. 60/434,326, the disclosure of which is incorporated herein.

BACKGROUND OF THE INVENTION

1. Field of the Invention

The present invention generally relates to golfing, and more particularly relates to golf training aids. The teachings of the present invention can be applied both to striking a golf ball in general (including driving and pitching), but more particularly to putting a golf ball.

2. Background Information

The present invention is based on the theory that the most efficient method of putting in the game of golf is to swing the putter in a true pendulum motion so that the face of the putter remains square or perpendicular to the line of the intended putt ("square-to-square") and the putter head remains on the intended line throughout the entire length of the stroke. The components that make up the pendulum "arm" in each golfer are the shoulders, the arms, and the putter.

While this disclosure specifically discusses the "square-to-square" putting stroke theory, it is expressly envisioned that the teachings of this disclosure could be applied to create methods and apparatuses configured to be utilized with the "inside-square-inside" putting stroke theory. Some of these methods/apparatuses are expressly discussed within this disclosure, while others are obviously functional equivalents and modifications of this disclosure.

With regard to the present invention, a pivot point is established between the golfer's two shoulders, from which the pendulum should pivot—all other hinges that exist in the pendulum, i.e. wrists and elbows, should remain constant throughout the stroke. As can be seen in FIGS. 1 and 3, the length of the pendulum or the radius of the arc is established by measuring the distance between the pivot point and the ground. Therefore, as the height of the golfer changes or their pivot point changes, so will the radius and the arc made by the pendulum. While this is one theory, there are other theories about this pendulum and pivot point, including but not limited to the actual pivot point being a point above the golfer's head (FIG. 18). While the preferred theory is discussed herein, this disclosure is clear that other theories exist and the present invention is adaptable to work with these other theories on preferred pendulums, arcs, and pivot points.

The putting stroke as it relates to the actual movement of the putter and in particular the head (and specifically the face of the putter) has three planes. See FIGS. 2*a* and 2*b*. Referring first to FIG. 2*a*, the X PLANE is the plane or angle of the putter face and its relative angle to the path of the intended line (this could also be referred to as whether or not the putter face is square with the stroke path . . . if the putter is not square when the ball is struck, the ball will not travel true to the stroke path). The term "stroke path" intending to likewise include the intended swing plane and/or the intended target line. The Y PLANE is the path of the putter head as it moves along the intended line of the putt (the "front-to-back" stroke path).

Referring now to FIG. 2*b*, the Z PLANE is the pendulum arc that the putter head should follow when swung. A fourth plane is that in which the putter face is allowed to change its pitch or loft relative to the Z PLANE and is called the W PLANE. It is possible for the W PLANE to change while the putter still remains on line (Y), square to the line (X), and on the perfect arc (Z).

The present invention is configured to address the Z PLANE in such a way that each golfer will be able to be custom fit apparatuses of the present invention for their particular pendulum length and therefore practice swinging the putter in a true pendulum arc that fits his/her specifications.

There are two designs contained in the Whitehouse patent (Patent No. GB 2,020,983) that vary greatly in design and function. One design (Version A) is a base that a putter is attached to by way of slots and the base is curved upward in the back swing. Version B is an adjustable base to which a putter is attached to a sledge device that moves along an inclined plane. The device in the Whitehouse patent dictates the movement of the putter in the X PLANE and the Y PLANE. However, in the Z PLANE, the base of this unit is curved in the backstroke portion of the putting stroke, but is not adjustable for different sizes of users. It is also not indicated that any certain radius length establishes this curve (Version A). In addition, the drawings of Version B indicate a flat plane that is angled upward and adjustable. Page 2 paragraph 25 indicates "a inclined planar member." Therefore, this unit does not dictate the movement of the putter in the shape of an arc. Furthermore, the sledge in Version B does not allow the putter face to pivot in the W PLANE. The unit indicates on page 2, paragraph 15 that "it denotes a low to low putting stroke"—not one in the shape of an arc. It appears that in both versions the putter is released in the follow through, allowing the golfer to make any number of mistakes or the ability to continue poor habits in this portion of the swing. In both versions, for the ball to be struck while the putter is being controlled in at least the X PLANE and the Y PLANE, the impact point appears to be when the putter is at a descending angle. This angle of attack will cause, in most cases, the golf ball to skid for a distance before beginning to roll. Although the ball position is adjustable, moving it any further away from the notch would mean the putter would not be attached to the base at impact, therefore not guaranteeing a square putter face at impact. In Version A, a specific putter must be used that enables it to fit into and slide along the base. The bases of the units are not adjustable for different grass heights on putting greens or other surfaces such as carpet. Assuming a very short grass level and placing the ball in the slot indicated, the thickness of the base itself would not allow a true ball to putter impact simulation. The base thickness may cause the ball to be struck by the lower portion of the putter instead of the "sweet spot." If the unit is placed on long grass, the ball may be raised to hit the putter in the sweet spot, but the grass itself, which would occupy the negative space of the ball notch may impede the forward progress of the putter blade.

The Springer patent (U.S. Pat. No. 5,437,458) does not allow the putter to be swung by the user in an arc. However, the arc track is wide to allow for golfers with different arcs to use the machine and effectively control the X PLANE and the Y PLANE. This margin for error in the arc track therefore does not dictate the arc or Z PLANE of the putter. The slider unit does not allow the putter rotation in the W PLANE during certain parts of the stroke. The putter is released in the upstroke. It is the opinion of many golf professionals that nothing after the point of club face impact with the ball has any effect on the path or flight of the ball. It may even be proven that if at impact the face of the putter is square and the path of the putter head is on line that the ball will roll true and on line. However, in reality, any golf coach or instructor would agree that a proper follow through is a symptom of success in a swing or a stroke. Therefore, allowing the putter to be released at impact does not teach the golfer how to properly follow through. In this device, the ball must be struck on the upswing. Due to the notch where the ball is positioned to be struck, the putter will always be traveling on the upswing. Impacting the ball on the upswing is thought by many to be the desirable approach.

Some researchers (Pelz, U.S. Pat. No. 4,437,669) have even shown an effective impact position to be two inches ahead of the bottom of the arc of the putter. However, this is the result of testing done in a controlled environment. In reality, there are several variables that may require a golfer to hit the ball at a different position in the stroke, i.e. loft of the individual putter, grass height, grass consistency, direction of grain, grass type, etc. Impact with the center of the ball to the sweet spot of the putter is not feasible in this device. The putter sits in a sled or a half box that contains a bottom with a certain thickness. This thickness, in addition to the thickness of the base, may cause an impact similar to that discussed by Whitehouse.

The device of the Woodson patent (U.S. Pat. No. 4,153,255) forces the putter to follow a backward and forward path that is parallel to the ground at all times or relatively flat. In addition, the unit uses wire or string to connect the putter to the sliding device between the rails. This device does not allow a golfer to hit putts in real life manner. Because the unit has a solid base with some thickness, any ball that is struck would fall off the edge of the base causing it to potentially go off line. Assuming the edge of the base was slanted or ramped to allow a smooth transition, this ramp effect would accelerate the ball, causing the user to have a false sense of feel for the speed of a putt. In addition, this device does not appear to allow the putter to rotate in the W PLANE.

The Donaldson patent (U.S. Pat. No. 3,471,155) does not dictate that the putter move through an arc during the swing. The unit does allow movement in the W PLANE, but only between 0 to 90 degrees (claim 8). This would allow the putter to pivot in the back swing, but not in the follow through. In addition, this unit is not adjustable for different grass conditions. This unit is not adjustable for golfers with different pendulum lengths. It is not possible to impact the ball while the putter is on the upstroke. The thickness of the base and the sliding unit combined may make a center ball to putter sweet spot improbable.

The Lee patent (U.S. Pat. No. 5,435,547) is a unit in which the putter is not attached to the device in any physical manner and therefore the user's putting stroke is in no way dictated by the device. Instead, this unit simply measures the characteristics of a user's current putting stroke. This unit appears to give feedback on the three planes, but does not teach the user how to correct errors or what a perfect stroke actually feels like.

The Tucker patent (U.S. Pat. No. 5,074,565) does not dictate the movement of the putter in the X PLANE because the putter is held loosely by the mounting device attached to the shaft in order to allow upward and downward movement. This would also allow rotational movement in the X PLANE. In addition, the device allows the shaft of the putter to slide in the mounting device, which allows the putter to be swung in an arc, but the device does not dictate that the putter is swung with any type of arc or a specific arc. This device uses rails that are parallel to each other and to the ground to dictate the movement of the putter.

The Fletcher patent (U.S. Pat. No. 1,545,648) does not dictate the movement of the putter in the X PLANE because the face of the putter is not manipulated in any way by the device. In addition, the unit does not dictate the arc of the putting stroke in any way and thus does not dictate the movement of the putter in the Z PLANE.

The Sterling patent (U.S. Pat. No. 4,334,684) does not dictate the movement of the putter in the Z PLANE when making the assumption that shaft is held in a fixed position in the mounting device. If this assumption is incorrect, then it would in fact not dictate the X PLANE and would allow for the putter head to move in an arc, but would not dictate that it move in an arc or any specific arc.

In the Pelz patent (U.S. Pat. No. 4,437,669), it should be noted that this device exists in the marketplace in a slightly different form than that which is claimed in the patent. Small, flat rails are available from the company that affix to the face of the putter with adhesive and run parallel to the side rails of the unit. It should also be noted that the putter does not attach to the outer guide rails in any way. Therefore, the argument could be made that the unit does not dictate the putting stroke at all. However, the unit is designed to guide the stoke through auditory and tactile feedback by adjusting the tolerances between the outer guide rails and the putter. To actually dictate the performance of the putter, there would have to be contact between the putter rails and the outer guide rails. However, because the unit is not designed for this type of contact, it would not work properly in a manner that would simulate a real putting stroke. This device does not dictate the movement of the putter in the Z PLANE. Even if the putter rails are attached to a putter and extremely small tolerances are maintained between the rails and the outer guide rails, the putter can still move freely in the Z PLANE. This device is designed as a feedback device and is designed to highlight imperfections in a putting stroke, not necessarily teach the user the feeling of a perfect putting stroke. As it reads in claim #1 " . . . a visual, audible, and tactual indication of an improper stoke . . . ." In addition, the Pelz device is not adjustable in the Z PLANE for individual golfers.

What is needed is an apparatus/method which simultaneously allows for control of the X, Y and Z PLANES (and optionally the W PLANE) for training a golfer on the correct putting technique. Embodiments of the present invention satisfy this need.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a golf-training device (and method) that teaches a golfer the feeling of swinging his/her putter in a perfect pendulum stroke. In one embodiment, the golfer attaches his/her own putter (the user's own, existing putter can be used . . . no special training putter is needed) to a carriage by means of two hinged magnets that adhere to the putter face and are located on the leading edge of the carriage. The carriage itself runs on rails that are supported by towers of a pair of base platforms of the unit. The rails are shaped into arcs predetermined by the specifications of each golfer and/or chosen by each golfer. The golfer is then able to swing the putter forward and backward to simulate a putting stroke. During the stroke, the putter will be held so that the face of the putter remains square to the intended line (X PLANE), the putter head stays on the intended line of the putt (Y PLANE), and the putter is swung in an arc that is custom fitted for or chosen by that particular golfer (Z PLANE). Alternatively, the pitch of the putter head (W PLANE) could be dictated or controlled.

A laser device is preferably attached to the unit (at a rear alignment plate) visually denoting the line of the putt. A second laser device could be located along one of the base platforms to denote ball position. The golfer could then place a ball between the rails and in line with his/her putter and strike putts using the device. Preferably, a peg system on the base of the unit allows the golfer to practice consistency in his/her stance. The unit is designed to be useful indoors as well as out. The unit is also designed to store easily.

Additional features of this embodiment of the present invention may include (but are not limited to): (1) controlling the putter in the X, Y, and Z PLANES throughout the back swing, impact, and follow through of the putt; (2) allowing the golfer to practice using a pendulum arc that has been custom fitted for their individual specifications and/or an arc that the user chooses that may mimic a professional golfer's stroke and/or the golfer's current stroke; (3) providing an open base design that allows the golfer to see the putting green along virtually the entire line of the putt; (4) permitting adjustment for different grass conditions and surface heights; (5) providing adjustable ball position within the stroke; (6) providing a laser alignment system that is used in conjunction with the unit which teaches the golfer to see the correct line of the intended putt; (7) configured to be useful for right-handed or left-handed golfers with minor to no adjustments necessary to the unit; (8) configured to allow the putter face to rotate in the W PLANE during the stroke while remaining perfect in the other three planes; and (9) configured to allow the golfer to use their current putter while practicing on the machine.

Further, the purpose of this disclosure's Abstract is to enable the United States Patent and Trademark Office and the public generally, and especially the scientists, engineers, and practitioners in the art who are not familiar with patent or legal terms or phraseology, to determine quickly from a cursory inspection the nature and essence of the technical disclosure of the application. The Abstract is neither intended to define the invention of the application, which is measure by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
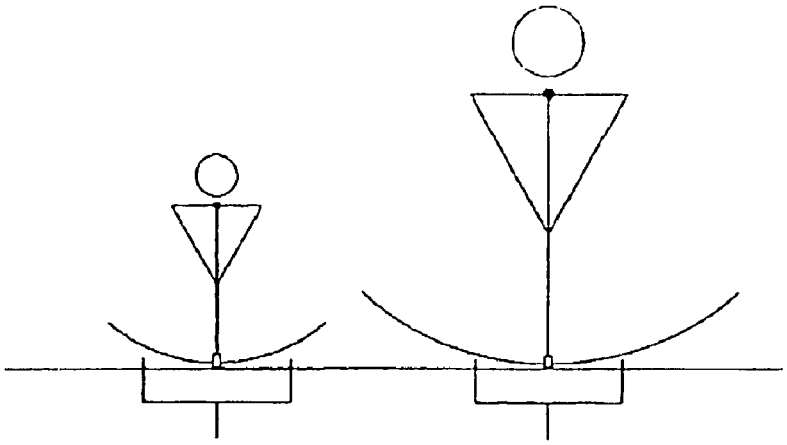
FIG. 1 is a schematic representation illustrating pivot point determination variances between shorter and taller individuals.
Figure 2A:
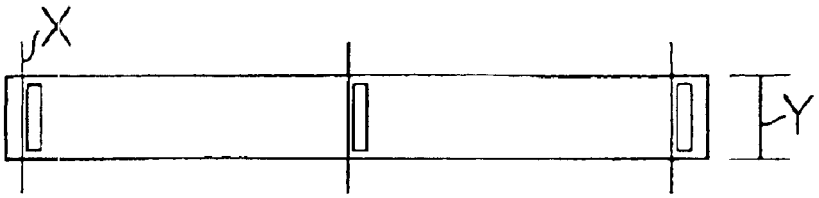
FIG. 2*a* is a schematic view of the X PLANE and the Y PLANE.
Figure 2B:
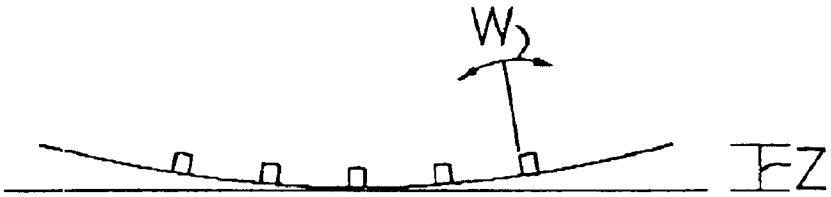
FIG. 2*b* is a schematic view of the Z PLANE and the W PLANE.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention comprises a plurality of method embodiments and apparatus embodiments. The teachings of each of these embodiments/apparatuses can be cross-applied as well as having discussed prior art elements added therein to form additional embodiments within the scope of this disclosure.

Referring initially to FIGS. 4–10, shown is the preferred embodiment of the present invention. In the preferred embodiment of the present invention, the base 18 of the golf putting machine unit 10 is made up of two long, narrow base platforms 20, 40 each possessing two vertical towers (22, 24, 42, 44), each one located one per platform end. The first base platform 20 having a first end 21 extending to a second end 23. The second base platform 40 having a first end 41 extending to a second end 43.

Preferably, the base platforms 20, 40 are attached to each other by the use of a rear alignment plate 60 and a forward alignment plate 70. The forward alignment plate 70 connecting the first ends (22, 42) together and the rear alignment plate 60 connecting the second ends (24, 44) together. It is preferred that the forward alignment plate 70 and rear alignment plate 60 rigidly connect the base platforms together, holding them aligned and generally parallel to one another without movement. This is preferred in order to keep the preferred embodiment of carriage from falling off the rails in use.

In the embodiment shown, the forward alignment plate 70 is attached between the first end 21 of the first base platform 20 and the first end 41 of the second base platform 40 through use of a plurality of attachments (62, 72). The attachments (62, 72) shown comprise thumb screws configured for screwing into threaded portions of the base platforms. Likewise, in the embodiment shown, the rear alignment plate 60 is attached between the second end 23 of the first base platform 20 and the second end 43 of the second base platform 40 through use of a plurality of attachments (64, 74). The attachments (64, 74) shown comprise thumb screws configured for screwing into threaded portions of the base platforms.

The alignment plates could also vary in their position, i.e. be affixed between the tops of the vertical towers. The alignment plates could be interchangeable, could be identical, or could have independent shapes, sizes and configurations.

While this particular alignment plate to base platform(s) connection/attachment is shown, this disclosure is intended to include any manner or means of connecting the platforms together (in embodiments utilizing a pair of opposed platforms). For instance, the plates could just rest on posts, thereby interconnecting the platforms through their weight/gravity. Another option would be that the alignment plates themselves contained the posts that would be inserted into holes in the base platforms. Other embodiments are expressly envisioned which do not require the utilization of a pair of opposed platforms.

It is preferred, as shown in the preferred embodiment, that the alignment plates 60, 70 be elevated above the ground surface, thereby allowing a golf ball to be putted there under. The alignment plates may differ in size, shape, and installation in order to perform different functions, or may be identical. It is preferred that the plates be clear or opaque to allow the golfer to be able to view the putted ball uninterrupted as the putted ball exits the machine.

In the embodiment shown, the applicant has expressly envisioned the creation of an embodiment able to be used by left handed and right handed golfers. For that reason, both alignment plates are elevated. Obviously, if one were to make an embodiment solely for a right handed golfer (or vice versa), the rear alignment plate would not need to be elevated in that a golf ball would never be driven/putted out of the rear of the device. Additionally, while the alignment plates are shown at the ends of the platforms, these alignment plates could likewise be located at other locations on the machine, including but not limited to extending between the towers. Because the purpose of the alignment plates is to hold the base platforms fixed adjacent to one another, and other alignment structure is likewise useful, including but not limited to a single alignment plate interlocking the two platforms together.

In this embodiment, the installation of the alignment plates 60, 70 onto the base platforms 20, 40 orients the platforms so that they are generally parallel to each other and at a generally specific, constant, predetermined distance apart throughout their length. The installation of the plates also brings the vertical towers into a position that is directly across from the tower on the opposing platform.

In the embodiment shown, each of the vertical towers 22, 24, 42, 44 on the base platforms 20, 40 contains a mounting bracket 25, 26, 45, 46 in which curved rails 80, 82 may be attached. This mounting bracket is preferably on the inner surface of the tower, facing the tower on the opposite base platform. Each mounting bracket is preferably adjustable upwards and downwards through use of an adjustment apparatus 27, 28, 47, 48 to achieve various and exact heights. In the embodiment shown, this is done via an adjustment knob located on the opposite (out) side of the tower. This knob having a threaded portion for receiving a threaded post. When the knob is tightened, friction holds the vertical location of the mounting bracket. When the knob is not tightened, the mounting bracket can be moved upwards or downwards and then locked into place by retightening the knob. While this adjustment is the preferred method of adjusting the height of the rails, obviously any number of other mechanisms could be used, including but not limited to friction fits, separate threads, posts, pegs, mechanical means, etc. Preferably, the mounting bracket can rotate to accommodate rails of different radii, perhaps through allowing the angle of the mounting bracket to be adjusted to receive different radii or different angles. Obviously, rather than use an adjustable adjustment apparatus/mounting bracket, the towers could be provided with a plurality of mounting brackets.

Optionally, a height indicator arrow (not shown) or other markings may be present on each tower on a side adjacent to the mounting bracket. This indicator arrow corresponds to markings on the tower to indicate the relative height of the mounting unit for that tower. While this disclosure discusses the optional use of such an indicator arrow, some embodiments will have such structure and some will not. The use of such terminology, with respect to the indicator arrow or other features of the present invention, is not intended to be a limitation on the present invention and on whether or not a particular feature must be present within a particular embodiment absent express language otherwise.

In the embodiment shown, a plurality of holes are defined within the towers for giving a user a visual reference in setting mounting bracket height. Allowing for changes in the mounting bracket height allows rails of different arcs to be accommodated. In addition, the rails can be adjusted relative to their height off the ground to allow for different grass levels.

Figure 17:
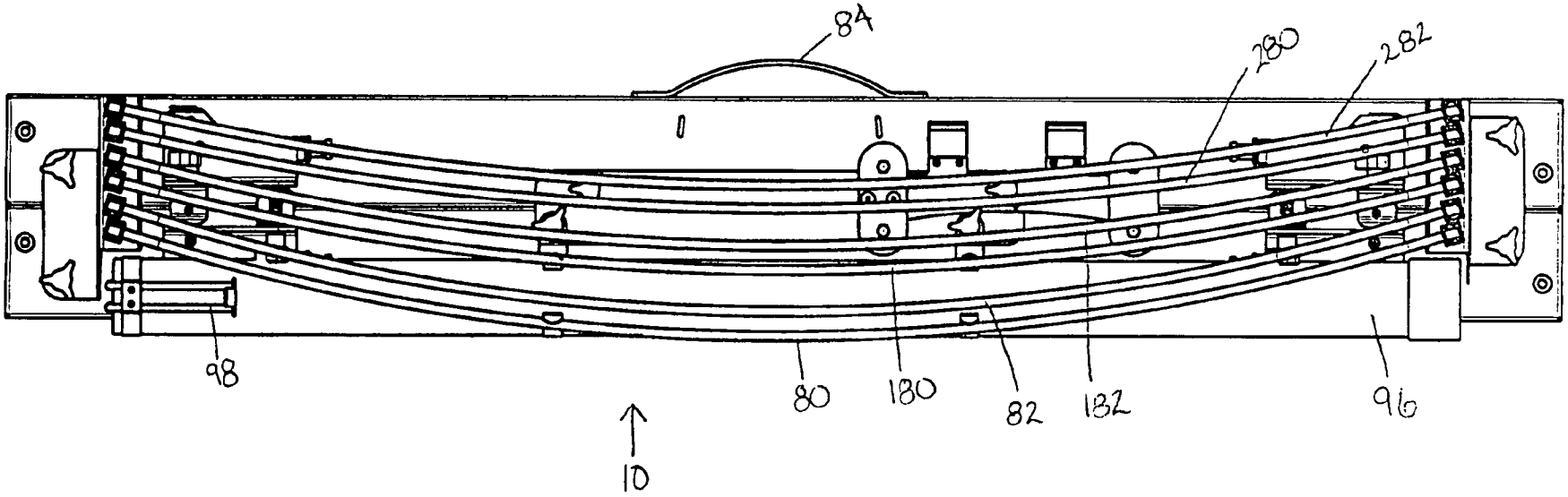
FIG. 17 one embodiment of the present invention collapsed for storage and/or transportation.

In the preferred embodiment, the towers are hinged (via hinges 31, 32, 51, 52) at their respective bottoms, thereby allowing them to fold down flat against the base platforms for storage, preferably locking down (via locks 29, 30, 49, 50) into a downward position during storage (as particularly shown in FIG. 17). The preferred hinges are spring hinges.

The guide rails 80, 81 of the present invention 10 are preferably arc shaped and round in cross section. In the preferred embodiment, the putting machine will be provided with a plurality of pairs of rails having a plurality of different predetermined arcs. In example, see the rails (80, 81, 180, 181, 280, 281) shown in FIG. 17. For instance, an arc could be used that correlates to a desired arc, the arc patterned after a specific professional or even the user's current putting stroke. Having a plurality of pairs of rails further allows the same putting machine to be utilized by more than one person (having differing heights, pivot points, etc.). The rails may be hinged in the middle to allow them to be folded for easier storage. Optionally, the ends of the rails themselves could comprise mounting brackets or other manner of attaching the rails to the towers.

In the preferred guide rails, the rail ends (as installed in the mounting brackets) may or may not be parallel to the ground. As shown in figures, in the preferred embodiment, the end of the arced rail is actually bent so that it is parallel to the ground and the base platforms. This will allow the rails to rest in the tower mounting brackets as well as being clipped in. The ends could therefore be an extension of the curve of the rail or could be straight. Due to the method of fabrication, the rail ends could also be a section of straight rod. The utilization of rails, per se, is not a required element of the present invention so long as the Z PLANE can be controlled some way.

Figure 32:
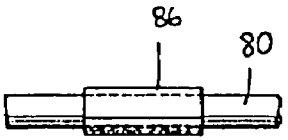
FIG. 32 is a partial, side view of one embodiment of a rail sleeve of the present invention.
Figure 33:
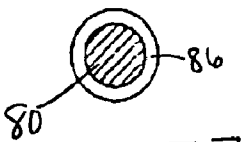
FIG. 33 is a cross-sectional view of FIG. 32.
Figure 4:
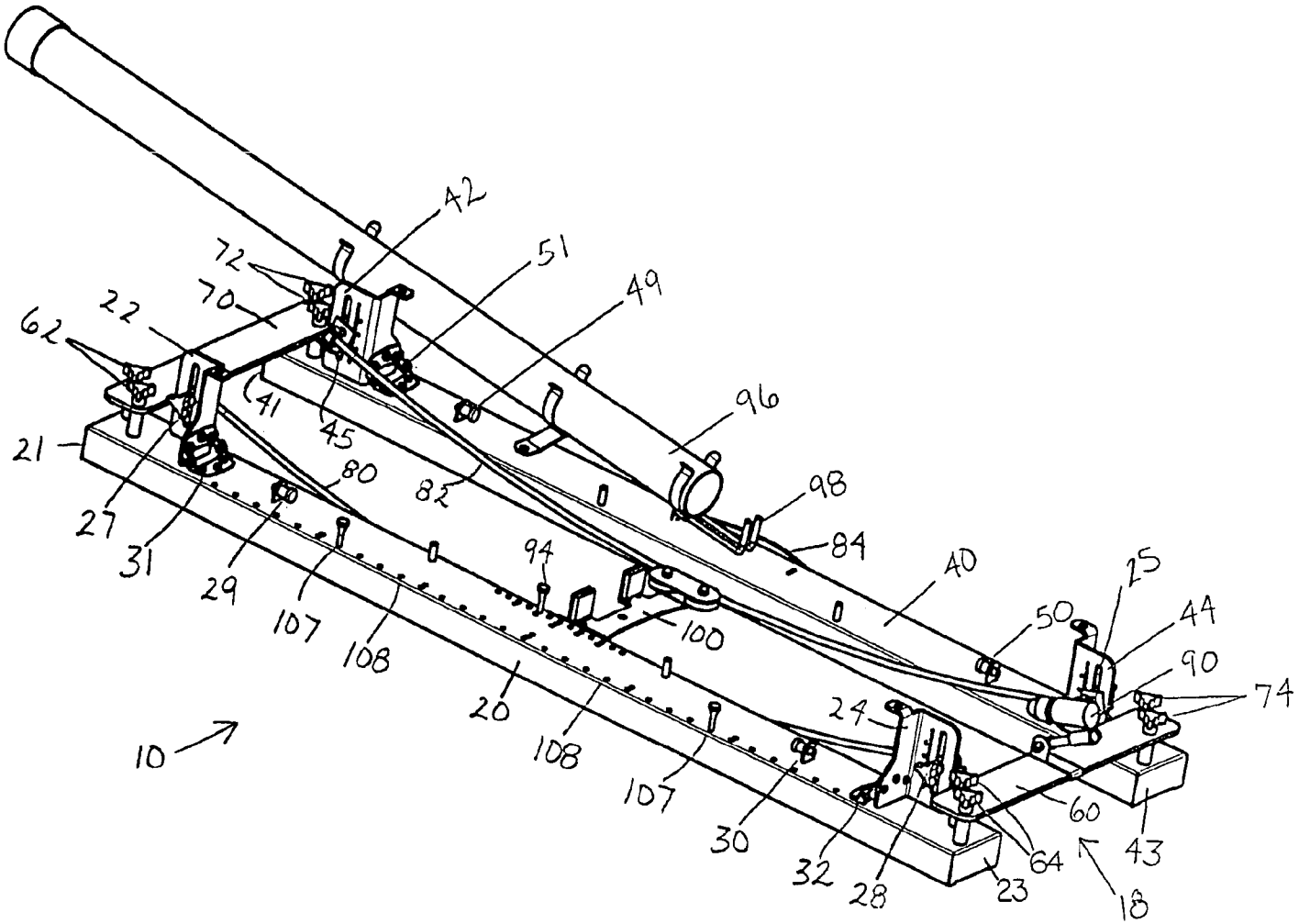
FIG. 4 is a first perspective view of a first embodiment of the present invention.
Figure 5:
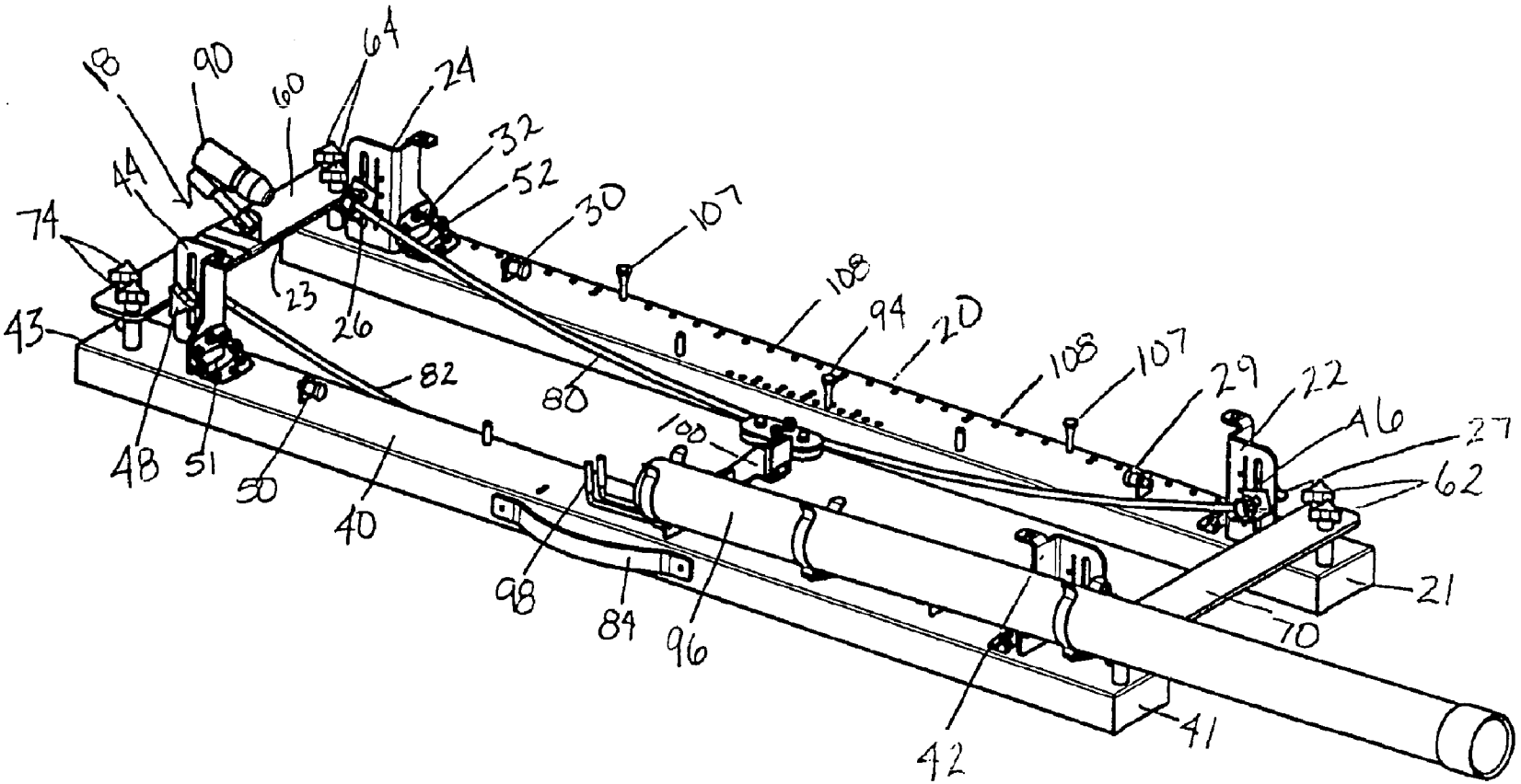
FIG. 5 is a second perspective view of a first embodiment of the present invention.
Figure 6:
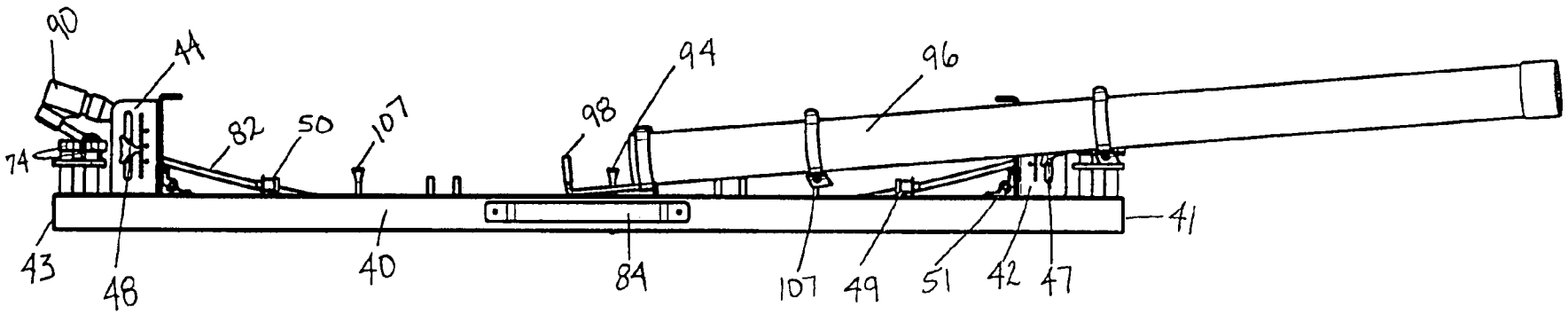
FIG. 6 is a first side view of a first embodiment of the present invention.
Figure 7:
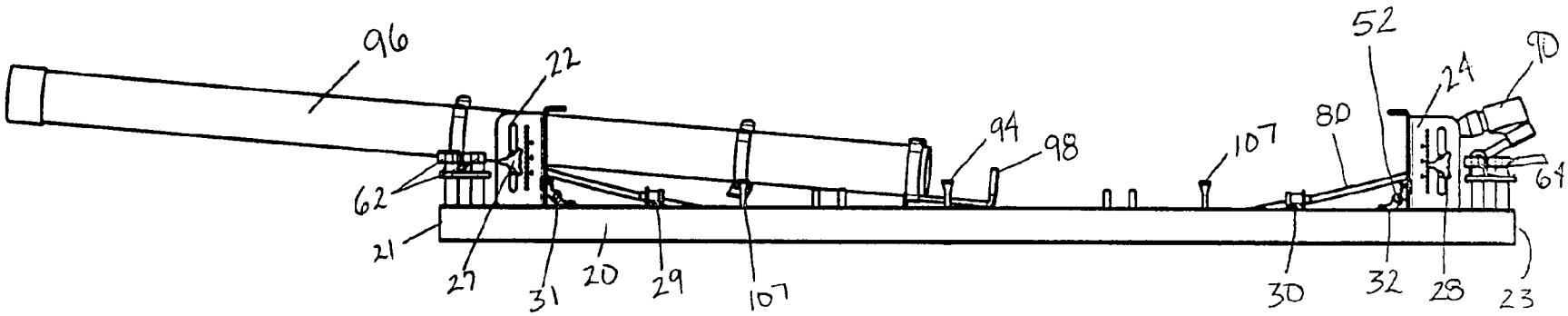
FIG. 7 is a second side view of a first embodiment of the present invention.
Figure 8:
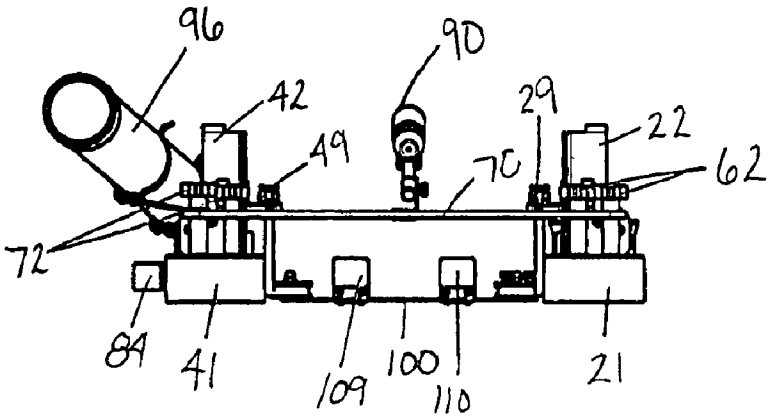
FIG. 8 is a first end view of a first embodiment of the present invention.
Figure 9:
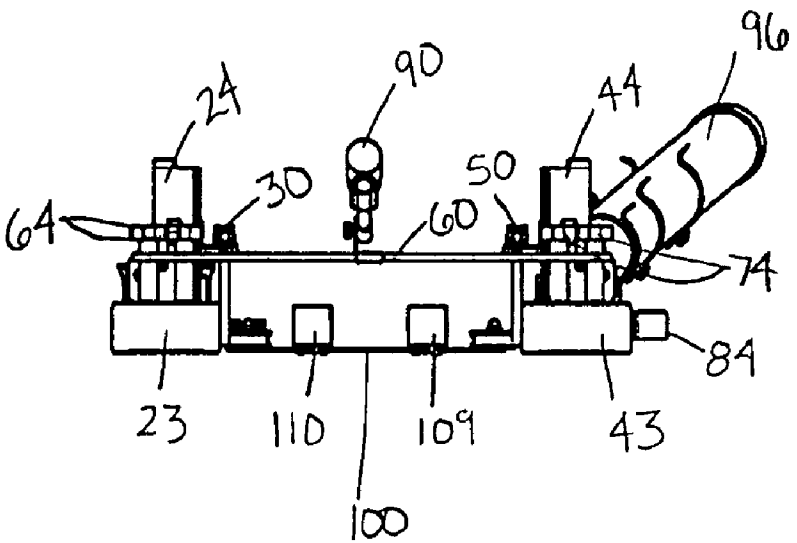
FIG. 9 is a second end view of a first embodiment of the present invention.
Figure 10:
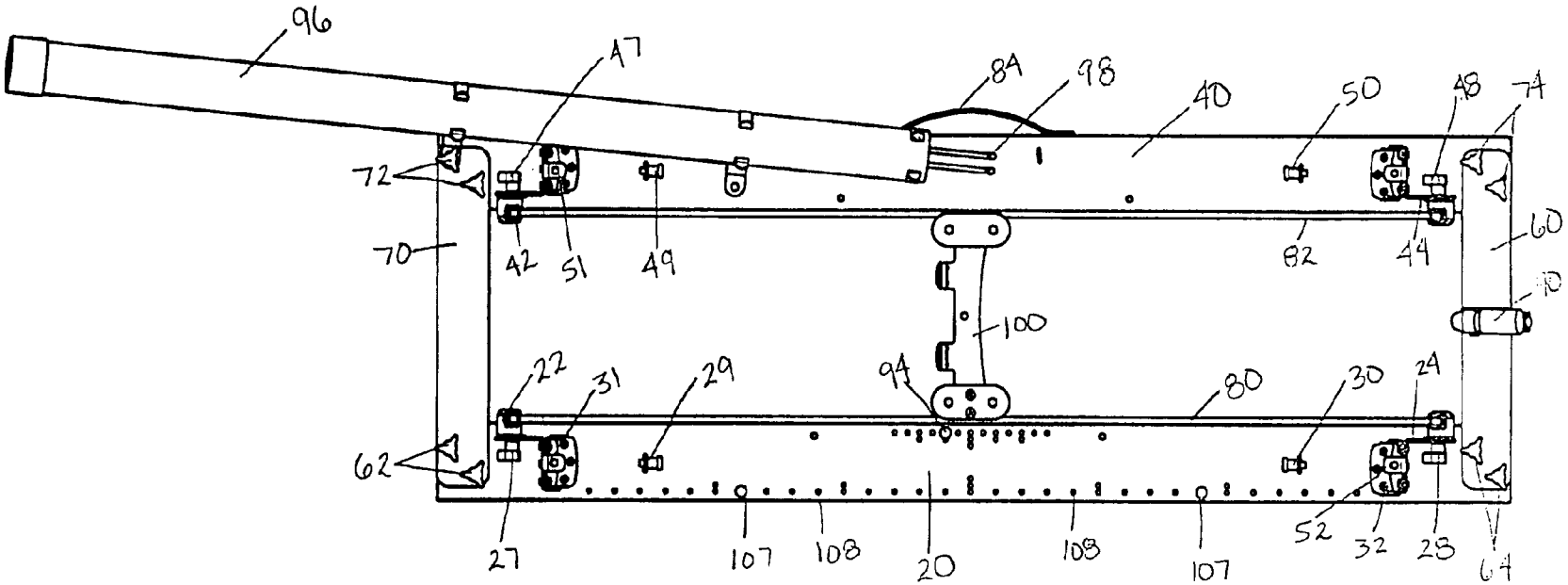
FIG. 10 is a plan view of a first embodiment of the present invention.
Figure 11:
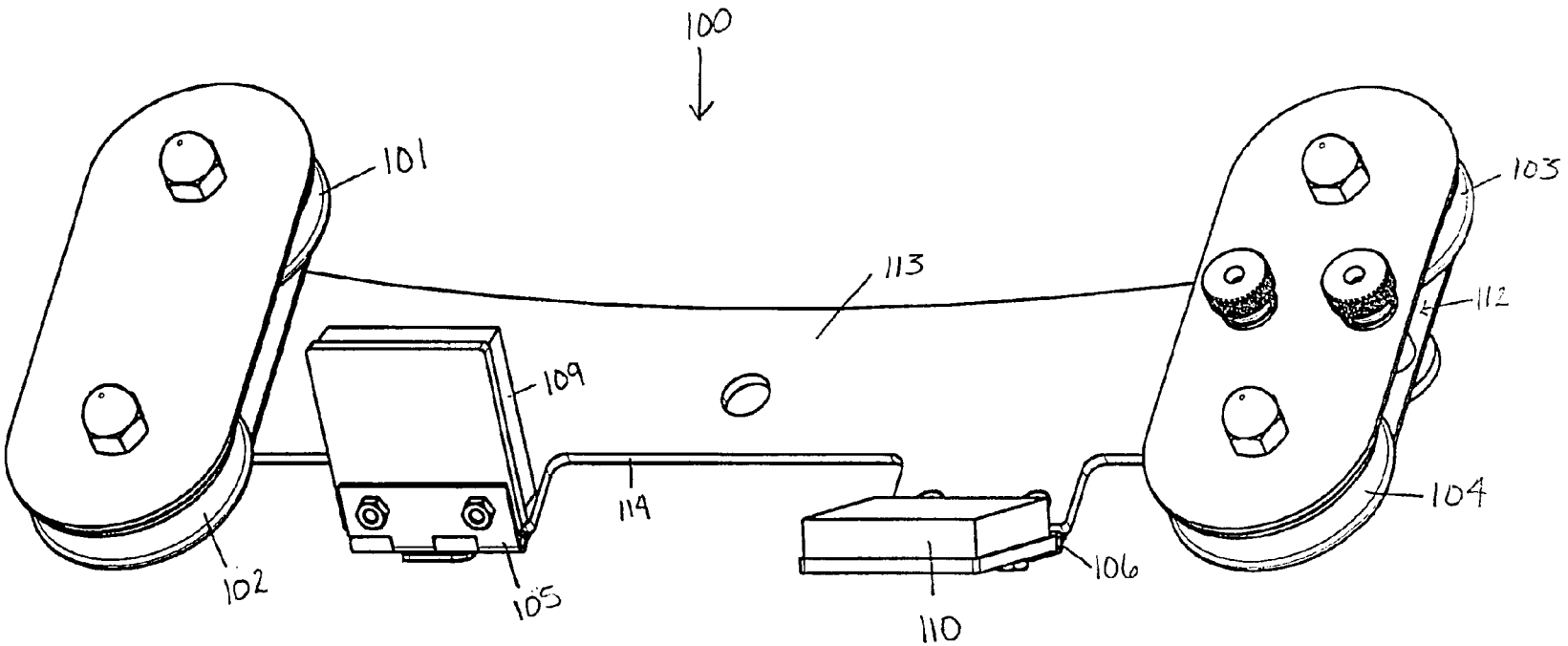
FIG. 11 is a perspective view of one embodiment of a carriage of the present invention.
Figure 12:
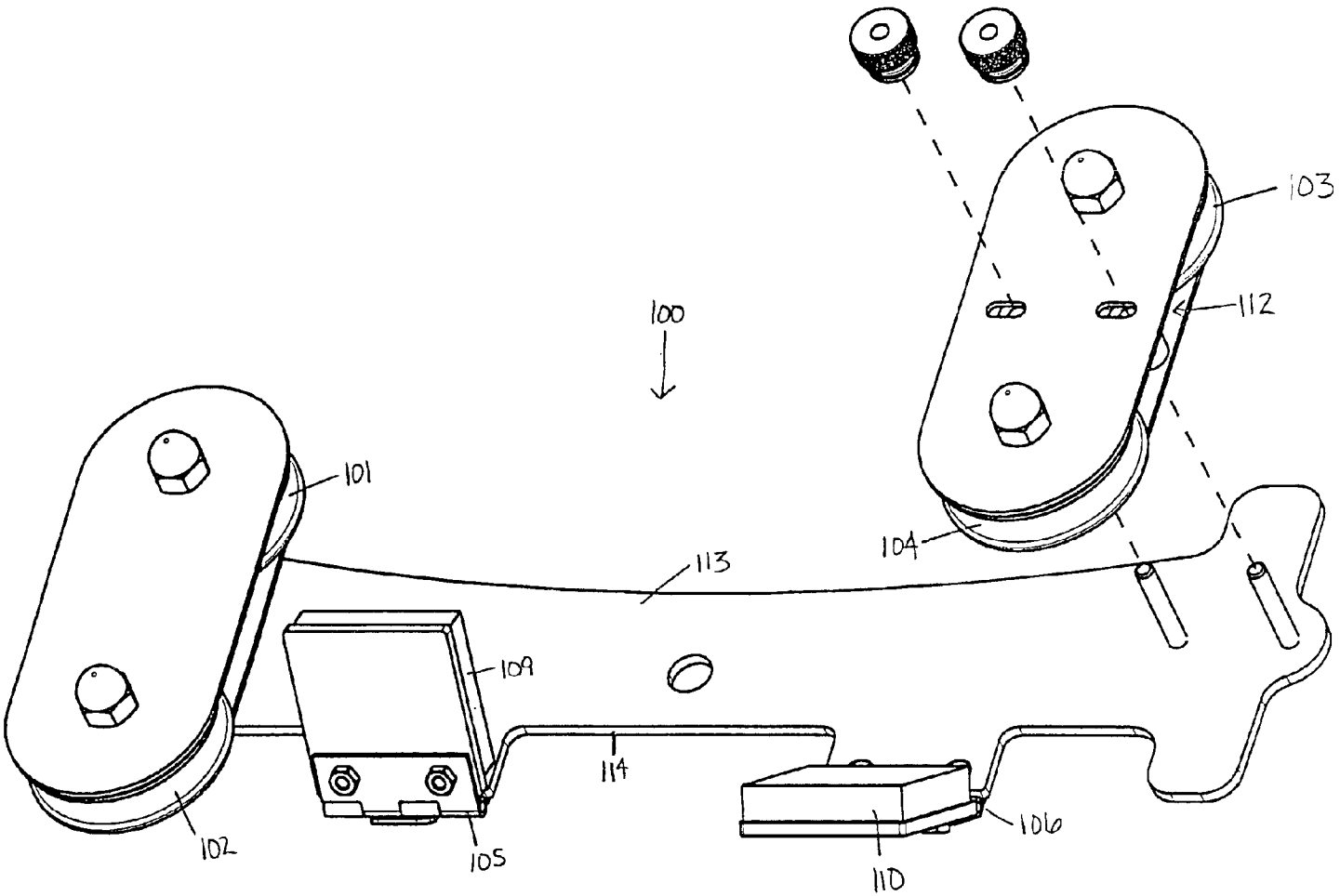
FIG. 12 is an exploded perspective view of one embodiment of a carriage of the present invention.
Figure 13:
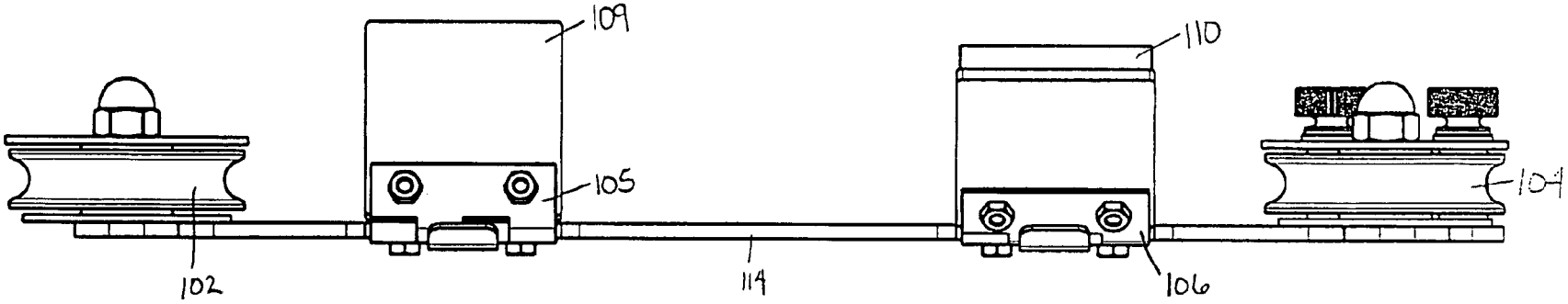
FIG. 13 is a first end view of one embodiment of a carriage of the present invention.
Figure 14:
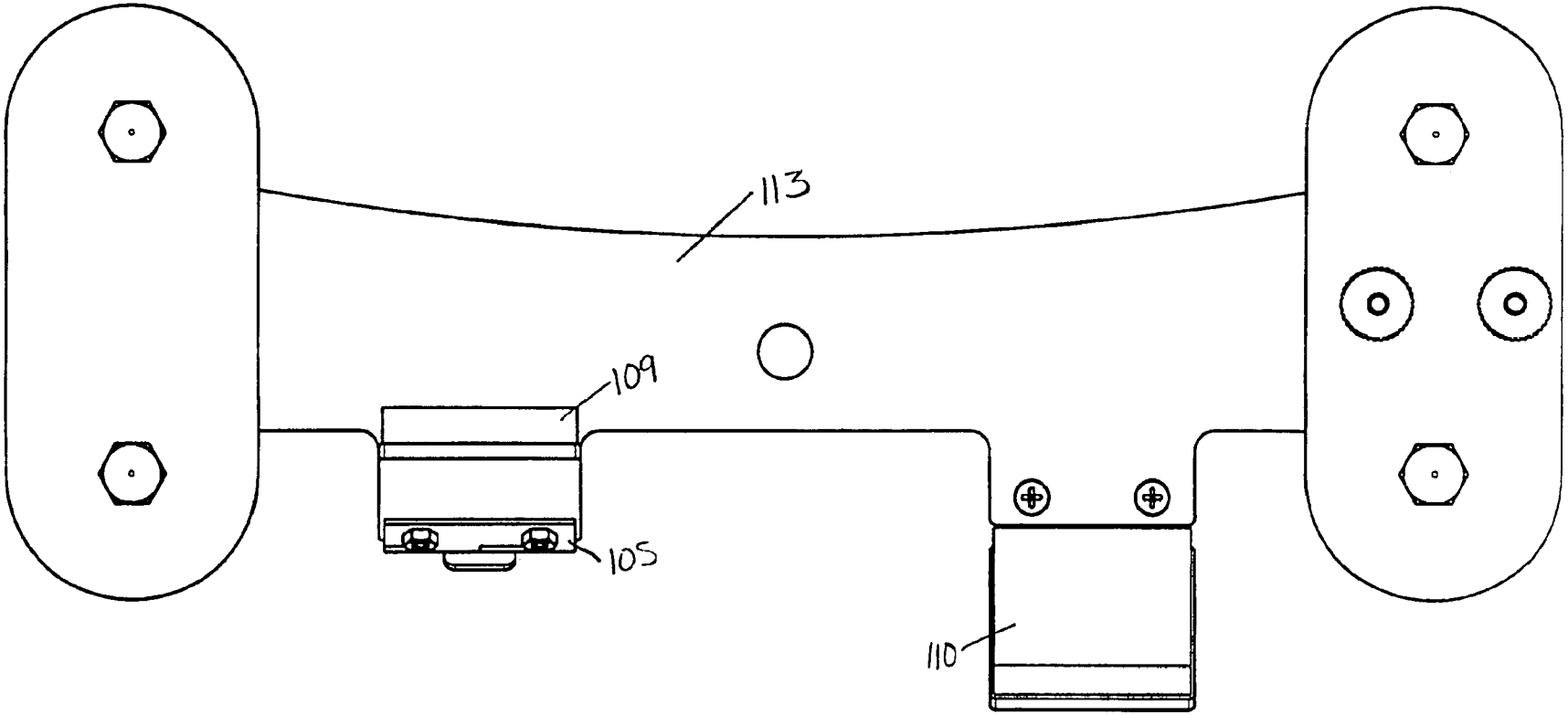
FIG. 14 is a plan view of one embodiment of a carriage of the present invention.
Figure 15:
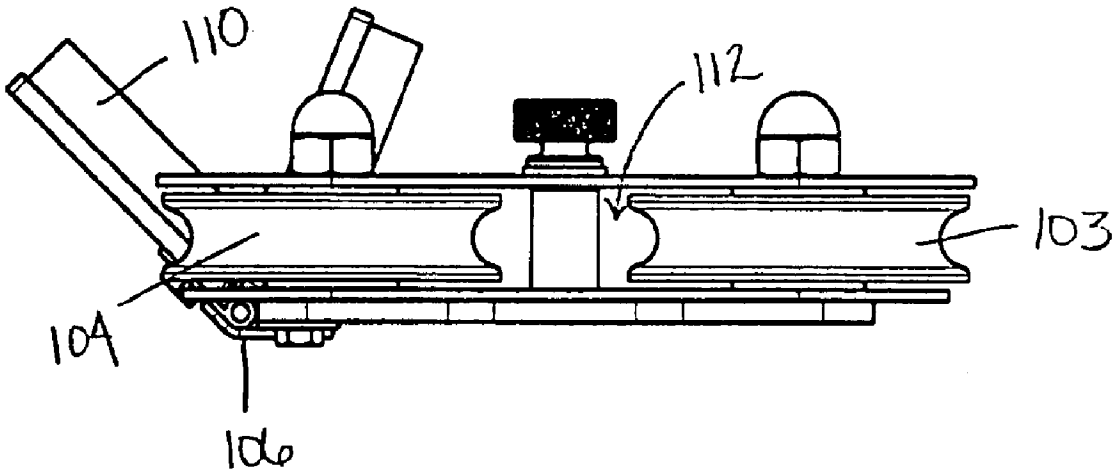
FIG. 15 is a first side view of one embodiment of a carriage of the present invention.
Figure 16:
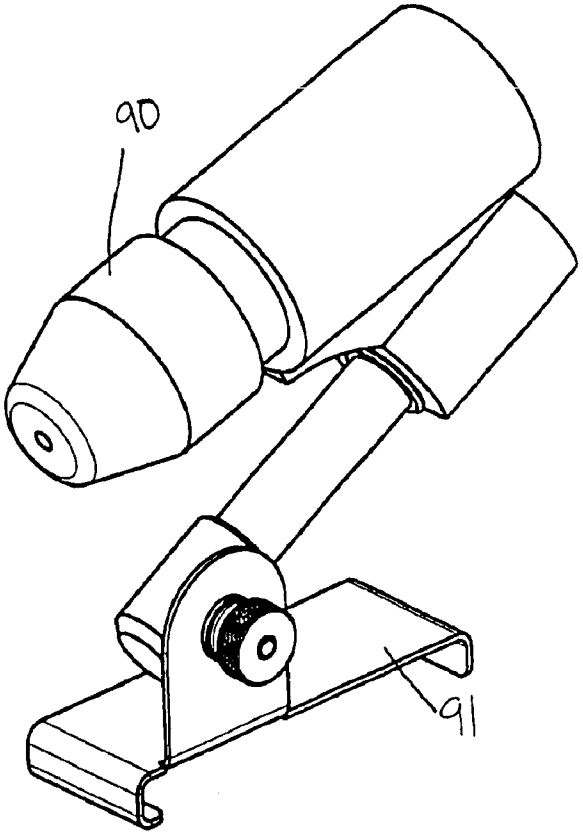
FIG. 16 is a perspective view of one embodiment of a rear laser of the present invention.

The rails would also accommodate attachments that would dictate stroke length. For instance, referring to FIGS. 32 and 33, a movement limiter 86 could be installed at one or more locations upon the rails. These and other resistance devices can be so installed and/or clipped onto the rails allow for the putting stoke length to be controlled. These devices acting to reduce the distance between the two rails therefore increasing the resistance to the carriage rolling along their surface. This resistance can be felt by the user as an indicator to begin the forward stroke. One such embodiment is shown in FIGS. 32 and 33. FIG. 32 shows a rail limiter 86 installed inline upon a rail 80. FIG. 33 shows a cross-section of FIG. 32, showing that this embodiment of a rail limiter or stop comprises a sleeve (preferably of plastic or rubber) encircling the rail. Other stops and limiters could likewise be installed onto the rail or other means of limiting travel along the rail could be used. The intent of such a movement limiter would be to keep the carriage (and rollers/wheels/bearings/etc.) from slamming into the mounting bracket(s) or other structure if the golfer's backward swing or follow through is larger than expected. It is preferred that a movement limiters be located at or near the first and second ends of each rail. These rail limiters could likewise be used as swing length indicators, decreasing the distance between the rails, thereby increasing friction.

Figure 3:
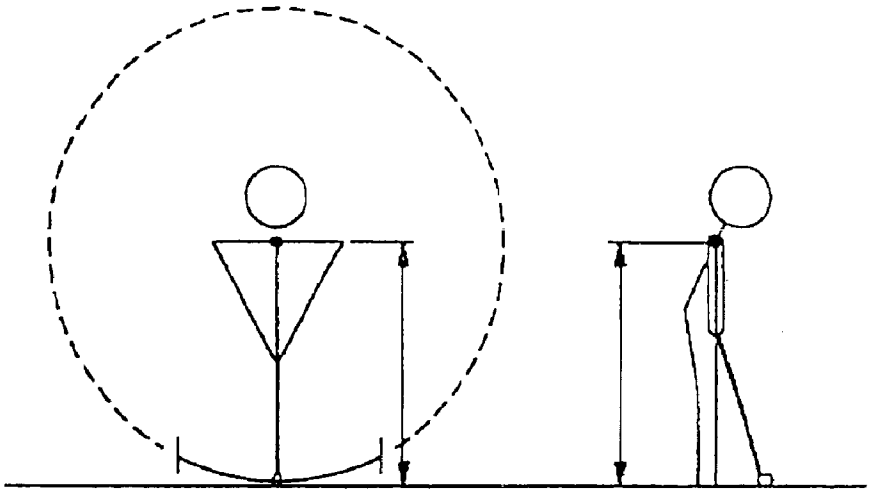
FIG. 3 is a schematic representation illustrating pivot point determination showing a front and side view of an individual.

The first two planes (X and Y) are constant throughout any perfect pendulum putting stroke for every golfer and every pendulum length. However, the third plane, or Z PLANE is potentially different for each golfer as their pendulum length or radius changes (see FIGS. 1 and 3). For instance, a golfer that is 6'3" tall will have a much shallower arc than that of a golfer who measures only 5'3" tall. For that reason, various golfers will need various curvatures of rails (ergo why the preferred embodiment of the present invention utilizes three different pairs of rails, as shown in FIG. 17).

To fit a golfer for guide rails that mimic a perfect pendulum stroke, their radius length is first determined by finding their individual pivot point. In the preferred embodiment, this is accomplished by establishing the point on their chest that is directly between their shoulder sockets. The golfer would then bend over at the waist and allow their arms to hang freely. Using a mirror or a friend for assistance, the golfer would assume their normal putting stroke, but with one requirement—their hands must be located directly below their shoulders. This requirement is necessarily due to the laws of physics that govern the way a pendulum swings. A pendulum could not swing in a true line if its arm did not hang directly below or in line with the pivot point.

The golfer (and/or his/her assistant) would then measure the distance from the pivot point or the outside of the shoulder socket to the floor directly below the point. This measurement is then used as the radius of a circle, which is used to determine the correct putter arc for the golfer. Circles with different radius lengths will have different arcs. Therefore, golfers with different pendulum lengths should also swing the putter on different arcs. The length of each golfer's radius could be measured exactly or could be estimated based on the height of the golfer.

Once the radius or pendulum length is established for each golfer they would receive a pair of rails with their unit that were bent for their radius. Or if the golfer didn't believe in the pendulum method of putting, then rails with different specifications would be available. For instance, a set of rails that forced the golfer to swing the putter low to the ground could be used. It is preferred that pairs of rails with different arcs would be interchangeable on any base unit of the present invention because the heights at the four vertical towers are configured to be adjustable. Particular rails would require the mounting brackets to be set at a minimum height. The user could then raise the height of the rails depending on grass conditions.

The rails may be made of a metal or other material that will be able to retain its arc shape as well as resist twisting or bending in unwanted directions. It is preferred that the rails will be custom bent for the arc that corresponds to each golfer or the golfer may choose an arc of their liking. An alternative to preconfigured rails would be to have one set of rails that could be bent into any size arc by adjusting the towers or other means. Additionally, the user could be provided with generally straight rails which the user him/herself bends to the desired shape. These are obviously less preferred embodiments of the present invention.

During use, the rails will be responsible for maintaining the Y and Z PLANES of the putting stroke. The arc of the rails will maintain the Z PLANE and the rail's rigidity would resist any force to deviate from this plane that would be exerted by the user. The rails would be attached at each tower using the mounting brackets and would also preferably be in contact with each base platform for a period of their length always to include the center or lowest point of the arc. The higher the rails were adjusted off the ground, the less of the arc would be in contact with the base platforms. However, the side of the rail corresponding to the low point (apex) of the arc would preferably always contact the base platform. Thus, together, the inside surfaces of the base platforms (in this embodiment) form a sidewall support for the rail guides when installed and are held parallel to one another by the alignment plates.

A golfer can make the perfect putting stroke, but if the golfer has not aligned his putting stroke (Y PLANE) correctly with the hole, the putt will not go in. Therefore, the present invention has a visual aid that not only helps the golfer align the unit for use in practice toward a particular hole, but also teaches the golfer to begin to visualize this line all the way down the intended target line. It is preferred that the putting machine 10 have a rear laser device 90 that is mounted on the rear alignment plate 60 or other location allowing a beam of light to be projected generally parallel to the Y PLANE, preferably centered within the Y PLANE (however it is likewise preferred that the laser be able to be moved laterally to allow a user of a putter having an off-centered center point to still use the present invention), forward from the putting machine 10, towards the hole or location putted to. This device projects a line (solid or dotted) or a single dot using lasers or another visible light source that illuminates the target line for the golfer.

In the preferred embodiment, the rear laser 90 is elevated above the rear alignment plate 60 by a vertical post or other mounting apparatus 91. The laser 90 is preferably adjustable on several pivots to allow the user to align the line perfectly each time or adjust it to project further down the target line. The rear laser 90 could be able to project different images to the ground by the use of interchangeable lenses. For instance, a solid line to indicate the line of the intended putt, an intended line (dotted), two parallel lines projected that would indicate the correct putter path, and/or simply a dot which could be used for target acquisition or "spot putting." Spot putting or spot alignment has been used widely in golf for many decades, and involves picking a single spot that is on the target line, but only 6 inches to a foot in front of your ball. The theory behind this is that it is easier to aim at something 6 inches away than 20 feet.

Figure 34:
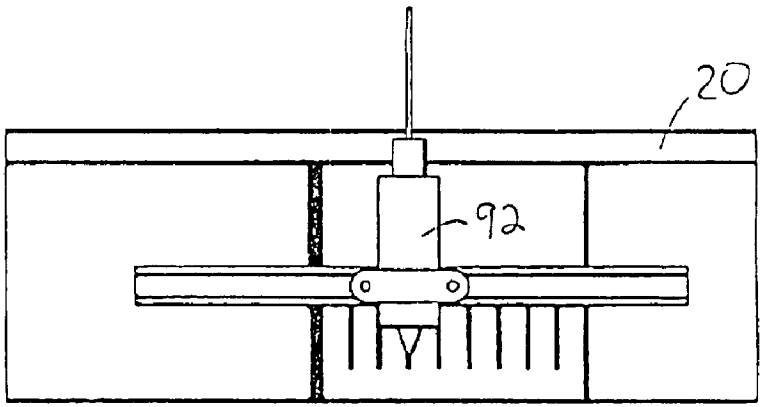
FIG. 34 is a partial plan view of one embodiment of a sliding ball positioning laser.

The unit 10 may also contain a ball position laser unit 92 (as shown in FIG. 34) on one of the base platforms that designates ball position. This laser preferably on a sliding track system that allows the golfer to designate the locations of different ball positions relative to the arced rail guide or Z PLANE. Numbers or markings on the slide or the base unit could indicate the ball position relative to the center or lowest point of the arc.

Referring now to FIGS. 11–15, in using the present invention, a putter (or other golf club) face attaches to the carriage device 100 (through a putter attachment). The carriage with the attached putter head is then able to roll along the curved guide rails 80, 81 by the use of a rail attachment such as the rollers 101, 102, 103, 104 attached to the carriage 100 as shown. While the preferred embodiment utilizes four rollers, it is expressly envisioned that more or less rollers could be used, and in other embodiments other mechanisms will replace the rollers entirely.

Thus, the carriage rests suspended between the two parallel guide rails by casters/wheels/rollers connected together with a carriage frame (base plank) and is able to roll freely along the length of the guide rails.

The preferred carriage frame is comprised of a very thin, rigid material. The frame is preferably attached to the rollers so that the bottom of the roller wheels and the bottom edge of the plank are even. The preferred carriage frame 113 has a recess 114 cut out of its leading edge in order to allow the attached putter face to strike the golf ball. The frame 113 configured for attachment both to the putter and to the rails. When installed on the rails, the leading edge of the frame is generally perpendicular or "square" to the guide rails. When the putter is attached to the carriage via the magnets (or screws), the putter face also remains generally square to the leading edge and generally perpendicular to the guide rails throughout the stroke. Therefore, this device dictates the X PLANE of the putting stroke.

The putter attachment, in this embodiment, comprising a pair of hinged magnets, having a magnet portion 109, 110 and a hinge portion 105, 106. In this embodiment, these hinged magnets are attached on the leading edge on either side of the recessed portion 114. The putter magnets on the carriage could also be made to be adjustable relative to their width apart with a minimum being dictated by the width of a golf ball. This could allow the accommodation of different sized putters and may serve to reduce the amount of error in the stroke with respect to hitting the sweet spot or middle of the putter face. Optionally, the magnets could also or instead contain small threaded holes through which a bolt or screw can be inserted and screwed into threaded holes on the face of a putter. This method would securely affix the putter face to the carriage. Being that a substantial portion of current putters on the market are not made necessarily of metal but of some composite material, the present invention is likewise adaptable. The carriage could attach to the putter through some other means (adhesives, hook and loop, buttons, snaps, friction fits, etc.) and/or something metal could be affixed to the putter in order to enable the putter to stick to the magnet.

These magnets are able to rotate 90 degrees forward and backward relative to the base plank of the carriage. Being hinged is preferred, but not mandatory. The magnets 109, 110 of the carriage 100 hold the putter in place, but also allow for the putter to detach from the carriage if the face of the putter is rotated or if the putter is moved too quickly or in a less than smooth fashion. Obviously, various strengths of magnets could be used to influence how sensitive the carriage's attachment to the putter is. Further, if the magnets on the carriage were electromagnets, this would allow a putter to be held in place at varying levels of resistance by changing the electrical current being supplied to the magnets. Such variation in the strength of the magnets would be useful because it would allow players of different abilities to set the carriage for their skill level. A beginner with a somewhat jerky, unpracticed stroke may need to set the magnets so that they will securely attract the putter and resist break away. A golf professional on the other hand may want to set the magnetism to a very light level, which would in turn allow the putter to break away if he/she did not perform a smooth stroke.

Preferably, the putter magnets hinge to allow rotation in the W PLANE (pitch) in both directions. Magnets may or may not move entirely through 180-degree arc relative to the carriage base. However, the magnets will have a range of motion that will accommodate any normal putting motion. The current specifications have an integral stop built into the hinge and/or carriage frame that does not allow the magnets to rotate too far forward and potentially hit the ground.

While magnets are discussed as the preferred manner of attaching the carriage to the putter, obviously other attachments could be used, including but not limited to hook-and-loop loop style fasteners, friction fits, straps, adhesives, welds, tape, bolts, screws, interlocking fits, etc.

It is preferred that the carriage width be adjustable in order to simplify installation and removal from between the rails. This system could consist of any number of mechanisms including but not limited to a bolt, rubber bands, springs, magnets, adhesives, etc. The carriage could also have a suspension system or shock absorbing system (for instance springs), which push one or more of the wheel assemblies outward to accommodate for any imperfections in the rails or rail spacing while keeping the carriage generally perpendicular to the line. One embodiment of a suspension system 112 is shown in the drawings.

The entire unit is designed for easy storage (as shown in FIG. 17). One embodiment would be disassembled as follows. To disassemble and store, the user would first remove the laser alignment units (if present). The rear alignment plate and the front alignment plate can then be removed. Next, the guide rails would be removed. The guide rails may contain a locking hinge that would allow them to fold. The two base platforms can now be placed very close together and parallel to one another. The rear alignment plate is then turned lengthwise and installed in the middle of the base platforms on existing posts, thus locking the two base platforms together. The front alignment plate is installed on top of the rear alignment plate by using two posts from the same side of the base platform. These units would be stored in a protective bag or attach to the unit in a safer orientation.

The base platforms preferably also contain holes 108 in which pegs 107 can be placed to mark foot placement stance position for the golfer(s).

Preferably, a ball position alignment laser is mounted on one of the base platforms in a permanent track in which it can move forward and backward lengthwise along the base platform. This laser projects a line onto the ground perpendicular to and between the two parallel base platforms. Markings on the base and the track indicate the lasers position relative to the bottom of the arc. Preferably, the user would then place the golf ball so that the back of the ball touches the laser line and their impact position will coincide with that which is indicated by the markings on the base. The laser could also be mounted on a track system that could be interchangeable from the rear alignment plate where it would project a parallel line indicating target line or to the base platform where it could project a perpendicular line indicating ball position. The unit rests in a track allowing it to move along a portion of the platform approximately between the center of the platform and three inches ahead of center.

Such a laser ball placement system will be useful for the golfer to practice a consistent ball position. It will also allow the golfer to adjust the ball position to one that is correct for their equipment and the conditions. For instance, if a golfer uses a putter with 5 degrees of loft, they may want their impact to be one inch ahead of the bottom of the putter's arc. But, a golfer using a putter with 2 degrees of loft may want to impact the ball when the putter is more on the upswing and may opt for a ball position of two inches ahead of center.

Grass conditions can require different characteristics from a putting stroke. Some grasses such as poa annua that tend to be shaggy and bumpy require that the ball be hit more on the upstroke to allow the ball to get on top of the grass and begin to roll. Other grasses such as bent grass tend to be very short and smooth and would allow the ball to begin rolling much faster if no loft or upswing was involved in the stroke.

Figure 21:
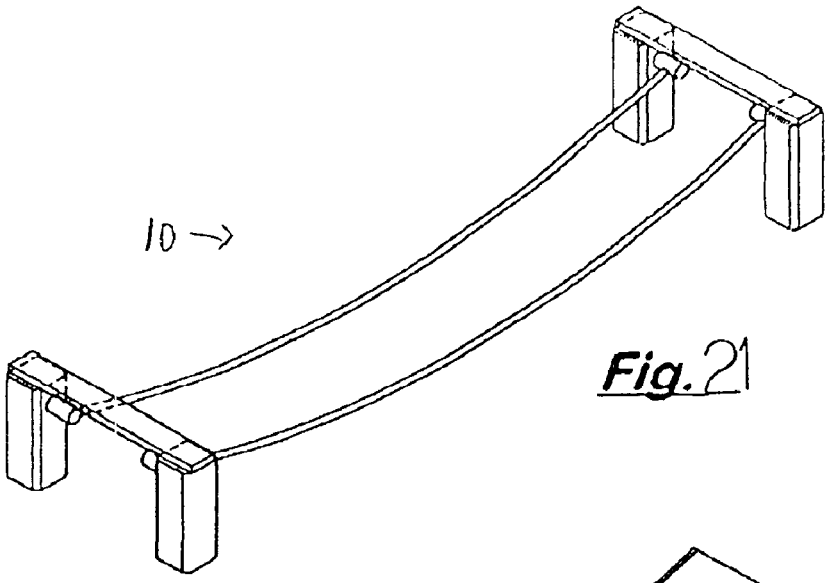
FIG. 21 is a perspective view of a third embodiment of the present invention.
Figure 23:
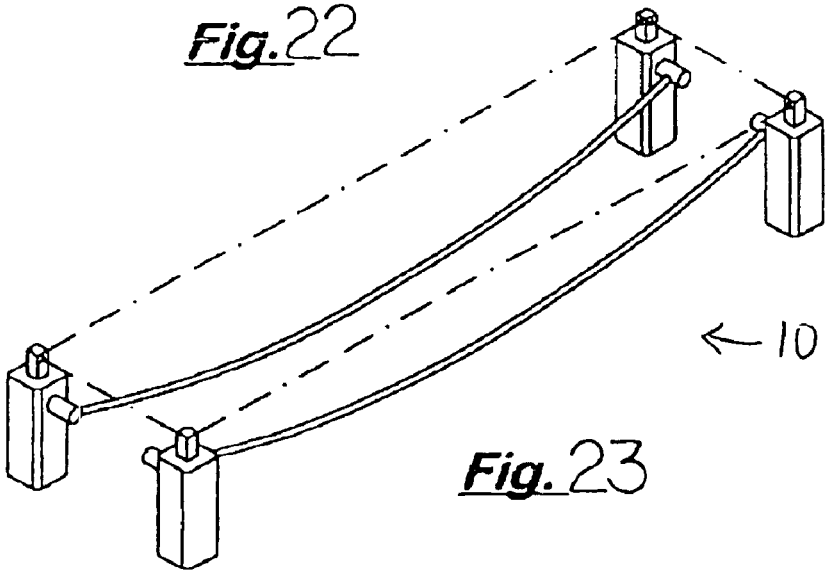
FIG. 23 is a perspective view of a fifth embodiment of the present invention.
Figure 24:
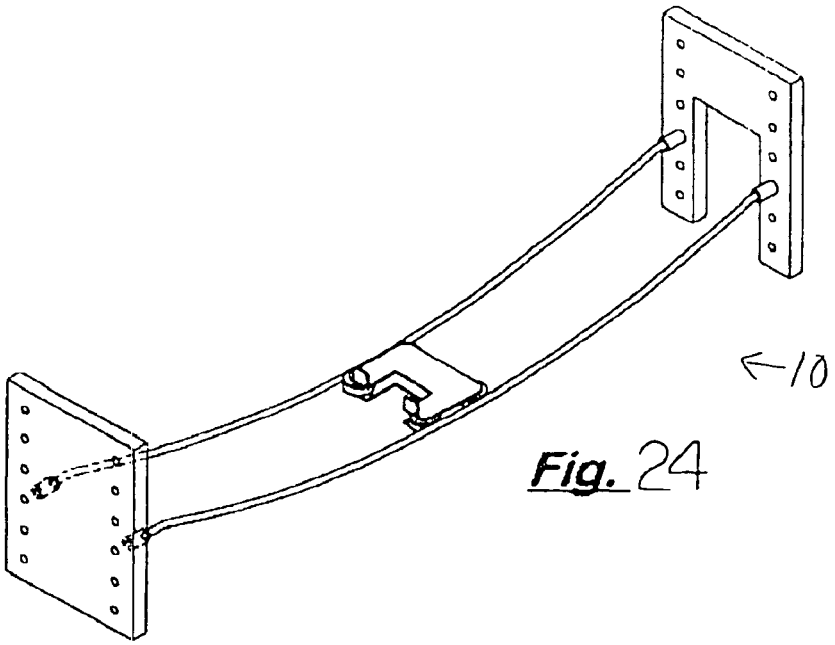
FIG. 24 is a perspective view of a sixth embodiment of the present invention.

The base platforms are not necessary to the invention. The vertical towers could exist as freestanding structures and still support the rail guides (FIG. 23). The vertical towers could also be connected to each other using a top beam. The towers could be connected lengthwise or adjacent towers could be connected (FIGS. 21 and 24). However, the user could simply line up the base units (FIG. 23) or freestanding tower structures by using other means to ensure they were parallel. The absence of some kind of interconnection between the different sides would not however ensure the units stayed parallel or correctly spaced during the stroke unless the mass of the units themselves ensured this. It is also feasible that the unit could remain parallel and constant with only one of the alignment plates installed. Therefore, either of the plates could be eliminated.

Figure 22:
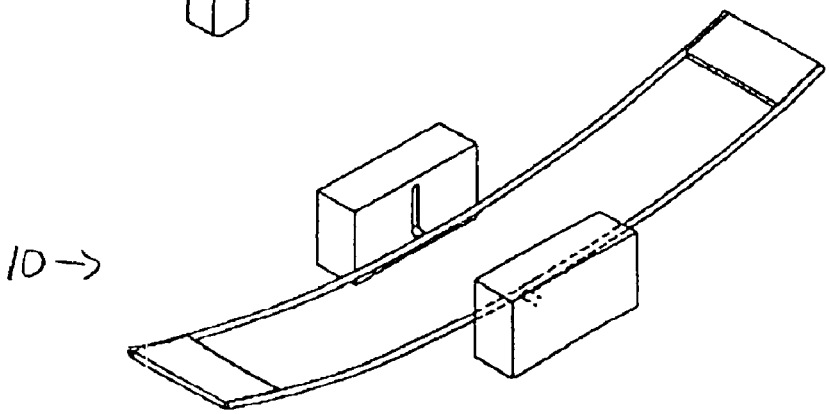
FIG. 22 is a perspective view of a fourth embodiment of the present invention.

The vertical tower structures are also not necessary for the basis of the invention to still exist. The guide rails could be oriented in a parallel position by any number of structures (i.e. FIG. 22).

The height adjustment feature of the towers is also not necessary. An arc shaped guide could be permanently affixed to a vertical structure. The guide would not be adjustable relative to the tower, but may still be adjustable by other means, i.e. adding an object beneath the tower to increase its height.

A curved rail guide is a necessary aspect of this invention. However, this guide would not have to be in the form of a round bar bent into a curve. The guide could take almost any shape in cross section. Furthermore, the guide could be a negative space that could accommodate a like shaped object that would be attached to a putter and be able to move along its arc (FIGS. 25–30).

Figure 25:
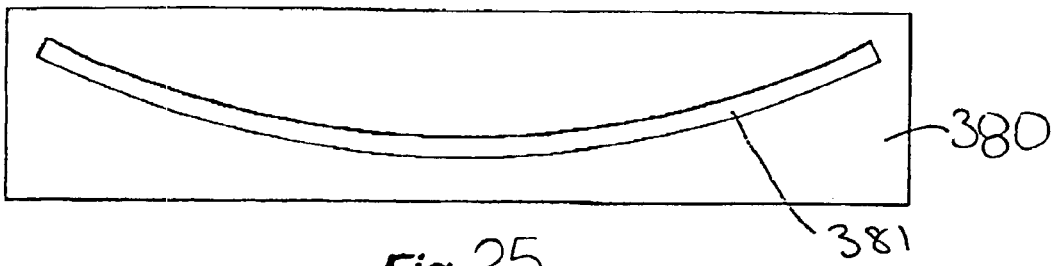
FIG. 25 is a side view of an alternative Z PLANE control (a seventh embodiment) of the present invention.
Figure 26:
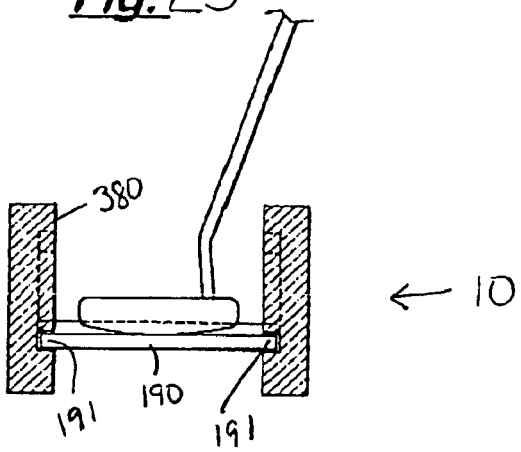
FIG. 26 is a front view of the seventh embodiment of the present invention.
Figure 27:
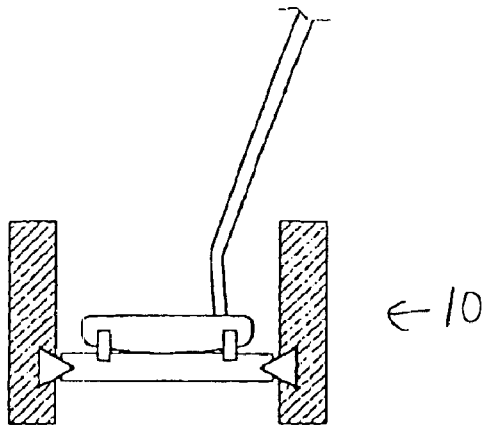
FIG. 27 is a front view of the eighth embodiment of the present invention
Figure 28:
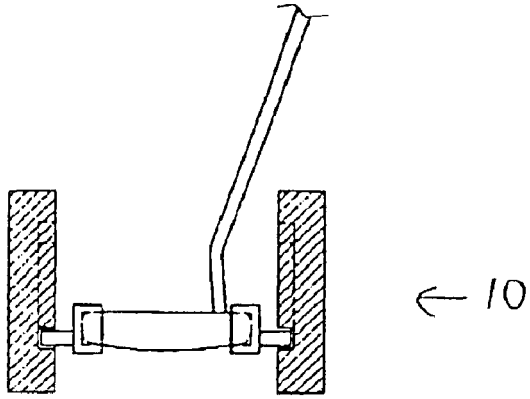
FIG. 28 is a front view of the ninth embodiment of the present invention
Figure 29:
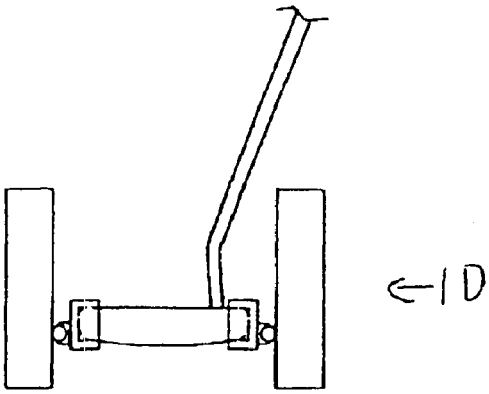
FIG. 29 is a front view of the tenth embodiment of the present invention
Figure 30:
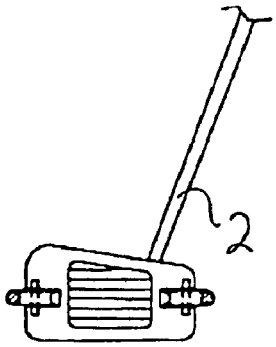
FIG. 30 is a front view of a modified putter which could be used with various embodiments of the present invention.
Figure 31:
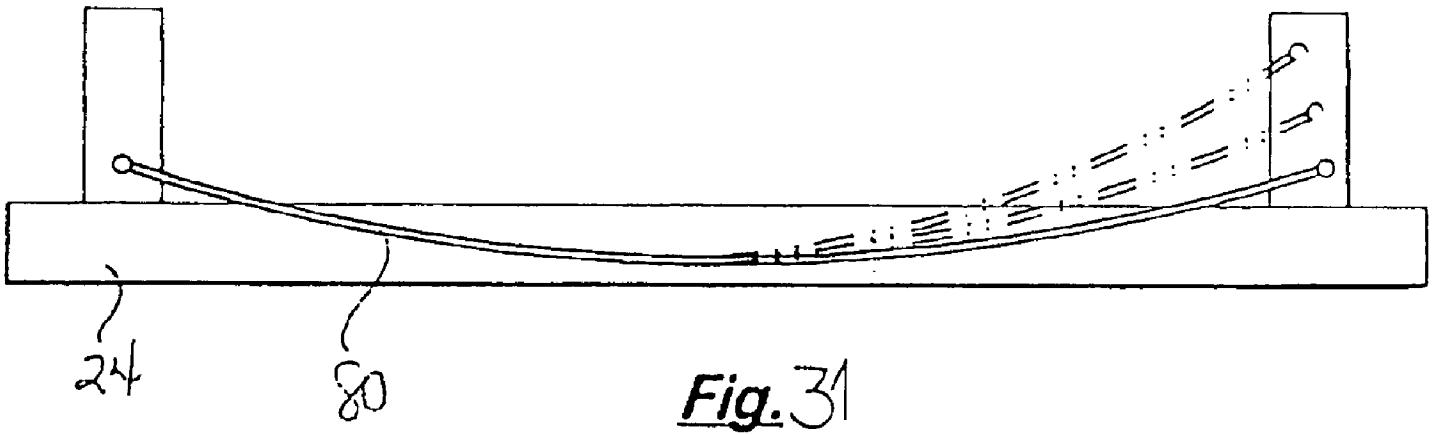
FIG. 31 is a side view of an eleventh embodiment of the present invention showing that the rails can be made of a flexible material.

FIG. 25 shows a side wall base containing a groove along which a carriage with protrusions could travel. FIG. 26 shows a cut away front view of a groove system (of FIG. 25) in which the carriage sits within the grooves and slides along them. This could be done with wheels, slides, ball bearings, etc. FIG. 27 demonstrates a sidewall with a protrusion, either permanent or temporary, fixed or adjustable that would compliment the carriage which would have opposite concave wheels or grooves relative to the sidewall protrusion. FIG. 28 shows a diagram of a carriage that could attach to each end of the putter or the toe and the heel that would allow it to roll along shaped grooves located in the base/sidewall of the apparatus. FIG. 29 show is the same as FIG. 28 except that the carriage is rolling along rails. FIG. 30 shows a golf club with built in casters or bearings that would allow it to roll along rails, further illustrating the fact that the present invention is not limited in application to putting training. This (FIG. 30) embodiment will actually be very feasible for chipping and short shots around the green. FIG. 31 demonstrates that the rails could be made of a flexible material that allowed them to take on different radii through manual adjustment or by adjusting the rail ends while having the rail center be fixed to the base or the sidewall.

The carriage, as described in the above form, is not necessary for the basis of this invention to exist. The "carriage" could exist in numerous forms that would facilitate a putter to move along a guide correctly in all three planes. Using the example of an alternative guide system being a groove (FIGS. 25–30), the carriage apparatus may be units attached to the putter toe and heel that fit into the groove and allow the putter to be swung along its path.

In the alternative, part substitutions and/or changes can be made without changing the basis of the invention. For example, the base platforms could be eliminated and four individual towers could form the base of the unit (FIGS. 21 and 23). The towers could be freestanding or each set of end towers could be connected. The user would then have to line up the two sets of towers using an alternative unattached guide or just by sight. In addition, the platforms could also exist raised above the ground or in a variety of different patterns that would connect two vertical towers together. Furthermore, the base platforms could also accommodate holding guide rails in position. The height of the rails could be changed by installing them into different pre-set positions (FIG. 24) or by means of an adjustable connection device.

Another example where parts can be substituted and/or changes made to the invention include, the function of the alignment plates are to orient the towers allowing the guide rails to remain parallel to one another. Accomplishing this is done simply by controlling the distance between two adjacent towers at one end and replicating that distance at the other end. Therefore, any device that could be measured and affixed to two different towers in the same way each time could accomplish this. Examples could range from screwing the towers together with a threaded bolt to a prescribed marking to attaching a length of wire to adjacent towers that when stretched would indicate correct and parallel spacing. The alignment plates, especially the front plate could possibly be designed to rest on top of the front and rear towers. This would allow the unit to be shorter in overall length.

Towers could also be equipped with laser alignment devices or sighting devices similar to those used in land surveying. By aligning the towers with a laser projected in a straight line or lining one tower up with another by means of a sight, parallel lines could be established.

The vertical towers could be eliminated entirely and the guide rails could simply be connected to the base of the unit. The towers could take on any shape or configuration either connected to a base or as stand-alone objects.

Another change is that a pegboard configuration could also be used to support the rail guides. This system would allow the user to strike putts and would allow for different rail guides as well as different grass heights.

The ability to adjust the height of the rail guides could be accomplished by any number of devices. The rail guides could be fixed and the base or towers to which they are attached could be adjusted. The guides could also be flexible allowing them to be bent to different specifications (such as those shown in FIG. 31). The guides could also be fixed and not be adjustable at all.

Any guide system that allows the putter to follow the arc of a pendulum could be substituted in the place of rail guides. If rails are used, they could have any shape of cross section and still accomplish the same function. A groove could also be used to guide the putter or a carriage to which a putter is attached.

Depending on the guide system used, the carriage system could be any device that facilitates a putter to be able to move along the guide system. For instance, if a triangular guide rail were used then the carriage would have complimentary structures that would allow it to roll or slide along the guide.

Individual attachments could also be affixed to the ends of the putter (or permanently installed into or onto a putter) to allow it to follow an arced guide.

The carriage device could also use alternate means of affixing a putter face to it. These may include, but are not limited to clamps, straps, screws, adhesives, and hook-and-loop loop style fasteners. The alignment plate is preferably made of Plexiglas, plastic, glass, or any other clear material that accomplishes the desired results of the present invention, however non-clear materials are also possible. The laser could mean any visible light source or device that could project an image onto the ground. The track system allows the laser to move forward and backward—track could also be guide or slide. The rollers could also be casters, wheels, rollers, ball bearings, skis, slides, etc. The carriage can be made of magnets and screws used to hold putter face onto carriage—screws could be fasteners, bolts, latches, etc. Magnets could be fasteners, connectors. Vertical towers are often mounting brackets such as fasteners, connectors, clamps, etc.

The present invention may also comprise an adjustable guide system consisting of flexible guide rails that would allow the user to bend them into different shapes and different arcs. However, this flexible material must also have the ability to retain its shape once bent into position. The challenge to having adjustable rails is that a true arc is difficult to produce and the characteristics that made the rails flexible would also not allow them to dictate the putting stroke.

Incorporating the laser alignment systems to be housed within other parts of the unit could be desirable. For instance, the ball placement laser could be housed within one of the base platforms and be adjustable through an exposed knob. The rear laser could also be housed within the rear alignment plate. Housing the lasers inside of other components would reduce the amount of parts that would have to be removed for storage. It would also give the laser devices a level of protection. In addition, it would streamline the appearance of the unit.

The preferred embodiment of the present invention comprises a ball placement apparatus, particularly an inclined ball tube 96 having a ball tube stop 98 for dispensing balls. Such a ball feeder system eliminates the problem of the user having to bend over after each stroke. The user can now knock a ball from the delivery system into the hitting area with his/her putter. It is preferred that the ball feed system further allows the user to pick up the golf balls from the putting green. The system consists of a standard ball shag tube that is open on one end and has a mechanism that allows balls to be picked up by putting the end over the ball and pressing downward. This is a one-way mechanism whereas the balls can enter, but cannot fall out. A clip is attached to the open end of the tube that allows it to attach to the base unit and allows golf balls to exit the tube, but be held exposed and ready for use. This open-end clip assembly also facilitates keeping the balls in the tube during storage. A clip attached to one of the alignment plate posts serves to support the tube and orient it in a downward position, therefore allowing balls to feed toward the user by means of gravity.

In the embodiment shown, the ball placement apparatus further comprising a plurality of ball hopper clips attached using storage posts (same as alignment plates). These clips then hold the ball hopper during storage.

Optionally, the ball placement system could be further automated, allowing for the placement of a new golf ball into the impact position for the next stroke of the putter. This could be in the form of a small robotic arm or simply a gravity device that drops a ball from a hopper.

The unit could be fitted with a different carriage device and a set of rails that could mimic a chipping stroke. A specialized golf club could also be used that contained casters that would allow it to roll along the rail guides in a manner that allowed it to contact the ground.

Front alignment plate is preferably located approximately two inches above the ground to allow a golf ball to pass beneath it. The space between the base platforms would need to be wide enough to accommodate a wide variety of putters. The vertical tower heights or other base units that supported the ends of guide rails would need to be a minimum height to accommodate a range of different rail specifications.

Preferred articles of manufacture. Rail guides—made of a low friction material. Carriage—casters or wheels made of low friction material that also served when rolled along rail guides would minimize sound. Base platforms—should be made of a material that would not kill grass if left upon it for a period of time in hot conditions.

Applicant notes that there are two main theories in putting with relation to the path that the club head travels during the putting stroke. One theory, called the "square-to-square" method says that the putter should swing straight back and straight through on the target line. Furthermore, that the face of the putter should be pointed at the target or stay perpendicular to the target line and the path of the putter at all times during the stroke. This method works on the principle that the arms and hands swing in a vertical plane that is parallel to the plane in which the putter swings.

The alternative method says that the putter swings on an inclined path because the shaft of the putter is at an angle. This theory is called the "inside to square to inside" theory. This is because the putter head swings inside the target line on the backswing and the face opens up relative to the target line. In the forward stroke the face rotates the opposite direction and the putter returns to the target line at impact and the face is square to the target line. In the follow through the putter swings back inside the target line and the face rotates closed relative to the target line. This theory is based on a putter swinging on an inclined plane as represented in the diagram above.

Figure 19:
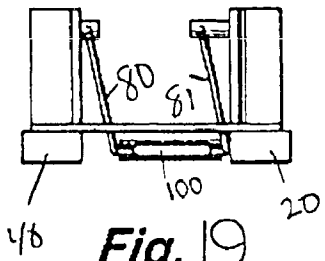
FIG. 19 is a first end view of a second embodiment ("inside-square-inside") of the present invention.
Figure 20:
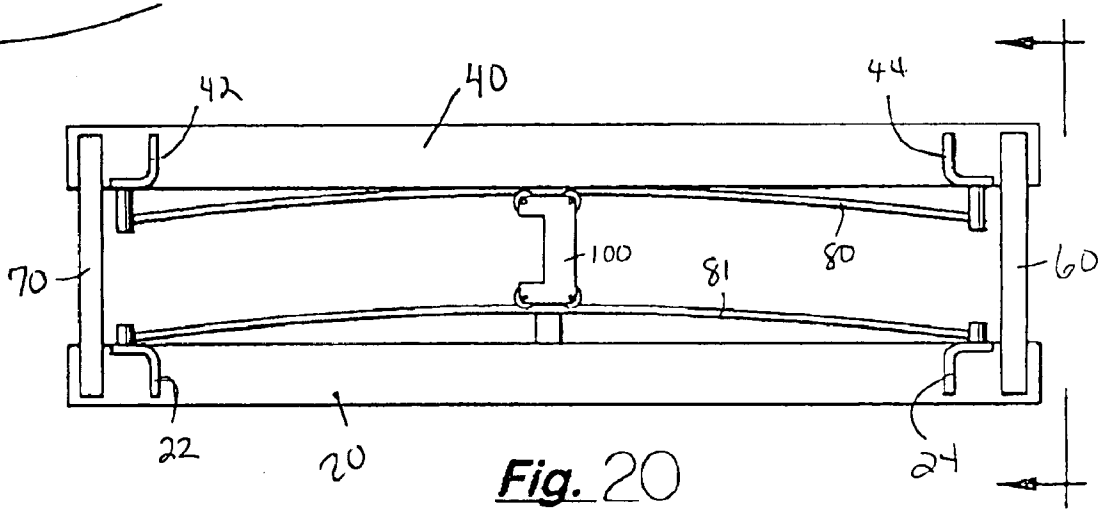
FIG. 20 is a plan view of the embodiment of FIG. 19.
Figure 18:
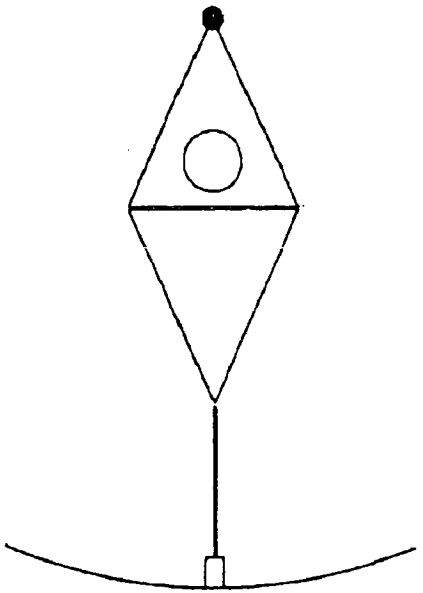
FIG. 18 is a schematic view demonstrating that the pivot point could be an imaginary point located outside of the golfer's body.

The present invention can dictate all three aspects of the stroke; path, face angle, and arc of the putter for both of these theories. Changing the machine from a square to square machine to an inside square inside machine would be a matter of exchanging some minor components that would set the rails at an angle relative to the ground instead of vertical. See FIGS. 19–20. Therefore, when the carriage ran along these rails the putter would move inside the target line and open up relative to the target line. The carriage and the putter face are staying perpendicular to the arc along which they are traveling, but not to the target line. The alternate orientation of the rails is shown in FIG. 19 from a back view. Whereas a back view of my preferred embodiment (FIGS. 8 and 9) shows the rails hanging at a 90 degree angle or perpendicular to the ground.

Describing the present invention with respect to inside square inside, raises an interesting challenge. To resolve this challenge and to make this disclosure clear, the applicant expressly states that the present invention and the equivalents thereto can be used with both the square-to-square and inside to square to inside methods. Particularly, even though the invention is explained as containing the method (and related apparatus) comprising the step of mechanically controlling the front to back movement of the club head along a stroke path to be generally parallel to the stroke path (Y PLANE), this language is intended to also cover inside square inside (where the stroke path is curved).

The teachings of this invention comprise not only the apparatuses, but the method(s) taught therein. To restate one embodiment of the training concept or method, the method comprises the steps of: mechanically controlling the front to back movement of the club head along a stroke path to be generally parallel to the stroke path (Y PLANE); mechanically controlling the club head to be generally perpendicular to the stroke path (X PLANE); and mechanically controlling the arc of the club head within the stroke path to follow a predetermined arc (Z PLANE. Optionally, the method comprises the step of mechanically controlling the pitch of the club head as it travels through the stroke path (W PLANE).

The present invention can also be viewed as a golf putt training apparatus for use in teaching a golfer how to swing a golf putter head through a stroke path to putt a golf ball, the apparatus comprising: means for controlling the front to back movement of the putter along a stroke path to be generally parallel to the stroke path; means for controlling the putter face to be generally perpendicular to the stroke path; and means for controlling the arc of the putter face within the stroke path to follow a predetermined arc. This embodiment obviously further comprising means for controlling the pitch of the putter head as it travels through the stroke path.

The present invention is likewise a golf putt training apparatus for use in teaching a golfer how to swing a golf putter head through a stroke path to putt a golf ball, said apparatus comprising: a base for supporting a pair of curved rails a predetermined distance above a ground surface; a pair of curved rails defining a path a carriage travels; and a carriage for following said curved rail path, said carriage configured for attachment to a golf putter. Wherein the base can be a first base platform interconnected with a second base platform. Wherein each of said base platforms comprise a pair of towers configured for supporting said curved rails. Wherein each of said towers comprises a mounting bracket for mounting said curved rails upon said tower. Wherein said base platforms further comprise adjustment apparatus for allowing the height of said curved rails above said ground surface to be adjusted. Wherein the device can further comprise a laser aligned with said stroke path for displaying to said golfer a desired putting path. Wherein the device can further comprise at least one ball placement marker for indicating the appropriate ball placement before putting. Wherein said putter is metal and said carriage is configured to attach to said metal putter through use of at least one magnet. Wherein said magnet is attached to said carriage through use of a hinge. Wherein said carriage comprises a plurality of wheels, each defining a groove in which said rail travels as said wheels roll along said track. Wherein said carriage comprises at least one spring for holding at least one of said wheels in engagement with said rail. Wherein the device can further comprise a pair of foot stance markers for indicating the appropriate foot placement the golfer should use. Wherein said first base platform is interconnected with said second base platform through use of a forward alignment plate and a rear alignment plate, said alignment plates elevated above the ground surface to give clearance for said golf ball to be putted there under. Wherein said curved rails are generally identical in shape. Wherein said curved rails define a curve, and wherein the curve of said curved rails is oriented generally perpendicular to the said surface. Wherein said curved rails define a curve and wherein the curve of said curved rails is oriented in a plane oblique to said ground surface.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A golf putt training apparatus for use in teaching a golfer how to swing a golf putter head through a stroke path to putt a golf ball, said apparatus comprising:

a base for supporting a pair of curved rails a predetermined distance above a ground surface;

a pair of curved rails generally identical in shape, said curved rails defining a path a carriage travels; and a carriage for following said curved rail path, said carnage configured for attachment to a golf putter, wherein said carriage comprises a plurality of wheels, each wheel defining a groove configured for horizontally engaging and receiving therein a portion of one of said curved rails, wherein said wheels rotate in the same general plane.

2. The golf putt training apparatus of claim 1, wherein said base comprises a first base platform interconnected with a second base platform.

3. The golf putt training apparatus of claim 2, wherein each of said base platforms comprise a pair of towers configured for supporting said curved rails.

4. The golf putt training apparatus of claim 3, wherein each of said towers comprise a mounting bracket for mounting said curved rails upon said tower.

5. The golf putt training apparatus of claim 3, wherein said base platforms further comprise adjustment apparatus for allowing the height of said curved rails above said ground surface to be adjusted.

6. The golf putt training apparatus of claim 2, wherein said first base platform is interconnected with said second base platform through use of a forward alignment plate and a rear alignment plate, said alignment plates elevated above the ground surface to give clearance for said golf ball to be putted there under.

7. The golf putt training apparatus of claim 1, further comprising a laser aligned with said stroke path for displaying to said golfer a desired putting path.

8. The golf putt training apparatus of claim 1, further comprising at least one ball placement marker for indicating the appropriate ball placement before putting.

9. The golf putt training apparatus of claim 1, wherein said putter is configured to attach to said carriage through use of at least one magnet.

10. The golf putt training apparatus of claim 9 wherein said magnet is attached to said carriage through use of a hinge.

11. The golf putt training apparatus of claim 1, further comprising a pair of foot stance markers for indicating the appropriate foot placement the golfer should use.

12. The golf putt training apparatus of claim 1, further comprising a ball hopper system for holding a plurality of golf balls, said hopper system configured to conveniently dispense said balls.

13. The golf putt training apparatus of claim 1, wherein said curved rails define a curve, and wherein the curve of said curved rails is oriented generally perpendicular to the said surface.

14. The golf putt training apparatus of claim 1, wherein said curved rails define a curve and wherein the curve of said curved rails is oriented in a plane oblique to said ground surface.

* * * * *